US010104991B2

(12) United States Patent
Reichel

(10) Patent No.: US 10,104,991 B2
(45) Date of Patent: Oct. 23, 2018

(54) ASSISTED EATING AID

(71) Applicant: Kurt Reichel, Mt. Shasta, CA (US)

(72) Inventor: Kurt Reichel, Mt. Shasta, CA (US)

( * ) Notice: Subject to any disclaimer, the term of this patent is extended or adjusted under 35 U.S.C. 154(b) by 374 days.

(21) Appl. No.: 14/495,133

(22) Filed: Sep. 24, 2014

(65) Prior Publication Data

US 2015/0090726 A1 Apr. 2, 2015

Related U.S. Application Data

(60) Provisional application No. 61/885,194, filed on Oct. 1, 2013.

(51) Int. Cl.

| | |
|---|---|
| ***A47G 19/00*** | (2006.01) |
| ***A47G 19/02*** | (2006.01) |
| *B65D 5/50* | (2006.01) |
| *B65D 1/36* | (2006.01) |

(52) U.S. Cl.

CPC ..... *A47G 19/02* (2013.01); *B65D 1/36* (2013.01); *B65D 5/50* (2013.01)

(58) Field of Classification Search

CPC . A47G 19/02; B65D 5/50; B65D 1/36; B65D 11/20

USPC ..... 220/575, 574, 574.1; 206/557, 559, 564, 206/565

See application file for complete search history.

(56) References Cited

U.S. PATENT DOCUMENTS

| | | | | |
|---|---|---|---|---|
| 2,757,525 | A | 8/1956 | Marsala | |
| 2,940,634 | A | 6/1960 | Wild | |
| 3,422,986 | A | 1/1969 | Tilseth | |
| 3,598,278 | A | 8/1971 | Vann, Jr. | |
| 3,773,212 | A | 11/1973 | Sekuler | |
| 5,390,816 | A | 2/1995 | Boyd | |
| 5,588,551 | A | 12/1996 | Morrow et al. | |
| D409,448 | S | 5/1999 | Hudson, Jr. et al. | |
| 6,241,096 | B1 * | 6/2001 | Littlejohn | A47G 19/03 206/503 |
| 7,506,489 | B2 * | 3/2009 | Schiltz | B31B 43/00 53/411 |
| 8,342,350 | B2 * | 1/2013 | Jain | A01K 5/0114 220/23.83 |

* cited by examiner

*Primary Examiner* — Anthony Stashick
*Assistant Examiner* — James M Van Buskirk
(74) *Attorney, Agent, or Firm* — Advantage IP Law Firm

(57) ABSTRACT

An assisted eating aid for use with an eating utensil constructed to carry food portions is disclosed as a serving vessel body having a bottom surface and an opposing upper surface with a centrally disposed food receiving region, an outermost perimeter, and a plurality of flanges projecting upwardly from the upper surface of the serving vessel body to divide the centrally disposed food receiving region from an outermost food receiving region where at least two of the flanges are spaced apart with each flange having an interior facing scoop surface and exterior facing scoop surface constructed to shove food portions pushed thereagainst onto the eating utensil.

11 Claims, 17 Drawing Sheets

ASSISTED EATING AID

CROSS-REFERENCE TO RELATED APPLICATIONS

This application claims the benefit of U.S. Provisional Application No. 61/885,194, filed on Oct. 1, 2013, entitled Assisted Eating Aid, which is incorporated by reference in its entirety.

BACKGROUND

1. Field of the Invention

The present invention relates generally to food serving vessels such as plates, dishes, bowls, trays, and the like. More specifically, the present invention relates to food serving vessels for providing a self-assisted dining experience for individuals such as those with physical disabilities, the elderly in need of feeding assistance, or toddlers requiring an educational aid during mealtime.

2. Background

For many various reasons assisted eating aids are commonly provided in the form of an eating vessel that incorporates an obstacle against which food may be captured between the eating utensil and the opposing obstacle in an effort to scoop food onto the eating utensil. Such eating aids provide not only an obstacle for the loading of food onto utensils but also serve as a barrier in the form of sidewalls, baffles or retention rings that are intended to prevent food from falling over the edge of a eating vessel onto the table or floor.

Over the years assisted eating aids have proven to be ineffective, cumbersome, impractical, difficult to clean, and/or difficult to manufacture. Most assisted eating aids available today are commonly referred to as dishes, a term generally used to describe vessels that are intended for the purpose of holding or serving food. As used herein, the general term dish includes serving vessels such as plates, saucers, bowls, mugs, glasses, platters, and even cups.

At times, users find themselves being forced to eat from an assisted eating aid that is more akin to a bowl with tall upwardly and sometimes inwardly extending sidewalls. Because of the opaque, high sidewalls, individuals find themselves impeded from accurately observing the utensil movement within the bowl/dish. Under these circumstances, not only do the individuals have to lean forward and look over the top rim of the sidewall, additionally they must exhibit enough physical dexterity to observe the obscured areas along the interior surface of the closest sidewalls of the bowl in an attempt to view the interior sidewall interaction with the utensil and the food to ensure food is being loaded properly onto the utensil. This unintended consequence when using a high rim, opaque wall limits observation within the bowl and makes it far more difficult to load the eating utensil properly thus adding to unnecessary false withdrawals of food or smaller portions requiring additional work.

Even greater objectionable disadvantages are present when the bowl/dish is used as an assisted eating aid for physically impaired individuals. Many physically impaired individuals, while able to move their limbs, are nonetheless unable to use their core or maneuver their upper torso forward in such a manner that could afford them an unobstructed view into the interior of the bowl/dish. Thus, what is meant as a potential aid actually winds up inhibiting the individual.

The impediment of tall bowl-like sidewalls also injects further difficulty as a learning aid for toddlers. Toddlers, while having the dexterity in most instances to move their upper body core forward in an effort view over the rim of the bowl and thereby observe the action between the eating utensil and the food, are nonetheless prevented from completing such a task simply as a result of their upper body core length. They are just too short in most instances.

In addition to the foregoing, other physical drawbacks exist for individuals with shorter arm reach, including, but not just limited to, those individuals with restricted shoulder or elbow extension ability. Extra physical effort must be exerted when an individual is using a bowl that forces upon them an expanded upward and outward movement required to successfully remove the food over the top perimeter of such tall sidewalls. This repeated increased physical effort, for those with physical impairments, will over the course of a meal induce a tiring effect, especially for those with limited energy, creating an environment that will certainly result in increased accidental bumping from the added movements causing the food to be imparted from the utensil either back into the bowl, or even worse, landing on the table or floor. The effort demanded from this repeated movement further exponentially diminishes the goal of a useful, effective or functional assisted eating aid that promotes dining independence, individual dignity, self-reliance, pride, and the autonomy desired by individuals seeking in a near normal dining experience.

Additional shortcomings arise with a bowl/dish devised with internal partitions or division walls that rise to the height found in a bowl/dish as they present similar problems to the sidewalls. Furthermore, it will be readily apparent to those skilled in the art that, unless the bowl/dish is disproportionately larger in size to a normal eating bowl, the area given to the internal compartment is far and away out of scale to the most common sized eating utensils. Adding food into the bowl/dish compartments and the area diminishes even more. These internal division walls or partitions add further impediments to the observation and function within the bowl, causing additional physical and visual voids at the intersection of the division walls and the base of the bowl/dish. For physically impaired individuals and toddlers alike, the internal division walls placed at right angles with the intersections of the bottom of the bowl make it impossible for an individual to view the food and utensil interaction and thus difficult to negotiate the eating utensil. Other disadvantages found in tall right angular internal division walls of such character become apparent when realizing that the user is prohibited from employing the aid as asserted. Simply put, the internal divisions do not exhibit the attributes provided by the peripheral sides, rendering them useless as an assisted eating aid. Removing food from an eating vessel by reaching over the top of tall internal division walls set at right angles is an obstacle that is difficult to overcome and burdensome for the user.

Also, it will be readily apparent that other apparent deficiencies exist when analyzing sidewalls having a single consistent angular alignment to the bottom of the vessel. It is known that food groups are comprised of different weight, sizes, textures, consistency, and density. Mash potatoes will interact within the assisted eating aid sidewall in a very different manner than that of small peas or even steak. Such differences in the qualities of the food types may require diverse obstacle angles of various shapes and different heights to enhance the successful loading of different foods onto the eating utensil that are not likely to be provided by a uniform sidewall.

Also, it will be readily apparent that, when washed in mechanical dishwashers, conventional bowl type eating aids with the sidewall characteristics described above are difficult to properly clean, rinse and sterilize unless they are placed flat and face down to prevent trapping food particles where the inwardly turned sidewalls adjoin the bottom of the bowl/dish. This type of odd placement dramatically reduces the usable area within the mechanical dishwasher, adding to the disadvantages of such construction.

Similar sidewall impediments found in the bowl/dishes eating aids are common in food-retaining devices adapted for mounting to an ordinary food plate. These retaining devices replicate the tall wall system of retention common in the bowl environment. As a result, the drawbacks for these devices, while removable, are the same as the bowl/dish with high sidewalls, that is, obstructed view, inefficient interaction with eating utensils, deficient biotechnology, and dysfunctional integration between the eating utensil, the retention ring and various food groups.

Other significant drawbacks found in conventional serving devices relate to the absence of any secondary system to catch or collect food that may be exported over the top of the sidewall, retention ring, or baffle, regardless of whether the export action was caused by a jerking motion, a learning experience, or just an overloaded utensil.

In addition to serving as an eating aid, some conventional devices are used as an educational aid for toddlers to develop proper feeding skills. An example of one approach to a child's self-feed training dish may be found in U.S. Pat. No. 2,757,525 to Marsala. Generally, this patent describes a dish for children with a conventional flat bottom and with an in-turned upper lip so that when a child tries to "scoop" a spoonful of food the excess food will fall into the dish instead of on the table adjacent such dish.

Another example of an educational-focused child's feeding dish may be found U.S. Pat. No. 3,773,212 to Sekuler. Sekuler teaches a feeding dish for training children how to scoop food onto an eating utensil, such as a spoon. In this approach, the feeding dish includes a flat bottom with an integrally formed acute or bow-like upwardly and inwardly extending sidewall that terminates in an edge having essentially the same shape as the outer edge of the bottom. Such a feeding dish purports to train children and toddlers to easily scoop food from the dish while generally minimizing the possibility of food accidentally dropping outwardly of the dish and onto the adjacent table or floor.

Another example of an assisted eating aid may be found in U.S. Pat. No. 3,598,278 to Vann Jr. Vann Jr. teaches a split ring shaped singular piece of flexible material having a substantially V-shaped cross section, adapted to receive and be mounted upon a food plate which is equal to or slightly larger in diameter than the diameter of the device itself. Mounting of the retainer device upon a plate is accomplished via a twisting and/or prying action exerted upon the ends of the split ring and thereupon inserting of the plate. The upper section of the retainer is disposed such that it slants upwardly and inwardly toward the center of the plate so that the inner surface thereof acts as a barrier to the food which is urged against it, and thus prevents spilling of the food over the edge of the plate or the retainer device itself.

Yet another example of an assisted eating aid may be found in U.S. Pat. No. 2,940,634 to Wild. Wild teaches a removable clip-on baffle for attaching to a plate, saucer, or dish for providing a baffle against which food on the plate may be pushed to facilitate placing the food upon a fork or spoon.

Yet another example of an assisted eating aid may be found in U.S. Pat. No. 3,422,986 to Tilseth. Tilseth teaches a device, attachable to a rim of the dish for the purpose of forming an abutment against which a fork may be pushed so as to scoop up food in a dish. The device includes a groove for receiving the rim of the plate and having an upstanding wall serving as the abutment.

Still another example of an assisted eating aid may be found in U.S. Pat. No. 5,390,816 to Boyd. Boyd teaches a dining plate helper in the form of an upstanding angular shaped abutment located on the food containing surface of the plate and angled inwardly with respect to the plate's peripheral edge. On the opposite side of the plate is contained one or more for protruding members to serve as legs enabling a series of plates to be stored one on top of the other in the stacking arrangement. In an alternative embodiment described in Boyd, additional food retaining members are located on the surface of the plate and are radially aligned in a circumferentially spaced manner. In yet another alternative embodiment disclosed in Boyd, the plate includes a utensil retaining rim and the protruding member on the opposite side thereof permitting stacking of a plurality of similar plates for defining a shallow bowl for retaining liquids such a soup.

Still another example of an assisted eating aid may be found in U.S. Pat. No. 5,588,551 to Morrow et al. Morrow teaches an eating aid comprised of a one-piece, integral, elastically deformed member having a top wall and a continuous side wall with a bottom edge surrounding a depression. The deformed member cooperates with a substantially smooth planar surface to form a closed chamber where the bottom edge is disposed thereupon and adheres to the surface by suction in response to a downward deformation of the top wall. The sidewall extends upwardly from the surface where the member is adhered thereto to form an inwardly arcuate abutment surface by and eating utensil onto the utensil when a user is eating food off of the planar surface.

In reviewing the approaches in the patents discussed above, it is clear that such approaches have additional disadvantages. For example, the Wild patent discussed above discloses a light, small removable baffle attached by means of resilient pressure formed by a upper and lower strip connected together by an intermediate portion which has the same or a greater degree of resilient consistency such that the intermediate portion will tend to hold the upper and lower strip portions resiliently together. The very object of this configuration creates a situation where the upper and lower strips intersect the attachment to the plate at a single point along its surface, thus creating a pivot point in the attached device. Any food point pushed against the baffle outside of this pivot will have a tendency to cause the baffle to pivot and inducing the loss the desired function. The pivoting action from this movement will add further frustration to an already difficult dining experience. Also, the very fact that there are many plate designs, from round, to square, too oval suggests that the removable baffle, with a hollow vertical depression (a curved face) would have difficulty meeting the conformity and connecting requirements for these other shapes dishes. Furthermore, plates have many various outer edge designs. Some curve up, some are S-shaped, and yet others may present a straight sloping edge with no curve at all. Consequently the upper and lower lip strip portions of the resilient clip disclosed in Wild will not commonly form a secure connection to various styles of plate edges further complicating the ability to maintain a useful baffle as an eating aid.

Additionally, the process of eating from a dish with a small removable baffle, or abutment as found in Wild (U.S. Pat. No. 2,940,634) and Tilseth (U.S. Pat. No. 3,422,986) presents many other disadvantages. The baffle and abutment both occupy only a small portion of the perimeter of the plate requiring the individual to either move aside a current food group so they can move yet another food group to the baffle/abutment area along the plate edge, or attaching multiple baffles/abutments along the outside perimeter to maximize the functional eating area. Even more complicated would be the requirement of moving baffle/abutment around the perimeter edge of the serving dish. Simply rotating the plate to another food group will cause even more problems, since the attached baffle/abutment will be rotated to an opposing position where it is rendered useless.

Again it will be readily apparent that the feeding dishes disclosed in Boyd (U.S. Pat. No. 5,390,816) and Morrow et. al. (U.S. Pat. No. 5,588,551) actually force a physical movement that is unnatural or ergonomically incompatible with the movement of arm or shoulder in individuals with physical impairments. The natural placement of the hand with the fingers at the farthest end of the extremity creates a secure pulling motion with the most leverage applied to the utensil extremity. This natural leverage is not to be found when pushing the eating utensil away from the torso toward the center of the dish by relying only the thumb to apply all the leverage to the utensil extremity. Pushing food in a direction away from the body torso toward a center abutment, regardless of the abutment shape is a cumbersome maneuver for those with physical impairments. Toddlers too would be at a disadvantage since in many cases they would run out of arm reach before any food would actually load onto a utensil. Additionally, in Boyd and Morrow et. al., food would have a tendency to build and damn in the small area located at the center of the plate causing congestion making it more difficult to separate and access a particular food item.

It is understandable that current devices and methods of eating from a serving vessel are inadequate at times when users are subject to experiences of obstructed view, increased physical effort, ineffective operation, substandard unconventional dining experience, and the absence of a secondary collection system for food that may somehow breach the sidewall, baffle or retention ring intended to prevent it from landing on the table or floor. Additionally, the current devices and methods used are feeble at providing a reasonable appearing replica of a conventional plate that de-emphasize embarrassment endured by those individuals who might find it necessary and desirable to use an assisted eating aid at mealtime. It is also understandable why the methods found in the prior art are inadequate when they fail to consider the numerous unanswered obstacles.

Finally, when analyzing conventional devices it will be readily apparent that the use of a baffle or abutment may be useful in overcoming some of the obstacles associated with loading food onto a utensil. However, other drawbacks become apparent in viewing these conventional devices given their employment of a single standard shape obstacle attempting to serve so many needs arising from variations in shape, height, performance, or functional biotechnology of the individual users. In addition, the absence of a backup catch system to prevent food that will likely reach the top of the abutment, sidewall, or baffle, virtually insuring the exportation of food onto the table or even worse onto the floor, leaves such conventional devices falling well short of serving consumer needs.

Thus, there remains a need for an assisted eating aid that overcomes the drawbacks of conventional serving vessels by improving the interaction between the user, utensil, and food placed thereon to improve the overall dining experience, especially for those of limited mobility or learning eating techniques at an early age.

SUMMARY

In accordance with the principles of the present invention, a preferred embodiment of an assisted eating aid for use with an eating utensil constructed to carry food portions may be provided by a serving vessel body having an upper surface, including a centrally disposed food receiving region and defining an outermost perimeter, and a bottom surface and a plurality of flanges projecting upwardly from the upper surface of the serving vessel body and dividing the centrally disposed food receiving region from an outermost food receiving region, at least two of the flanges being spaced apart with each flange having an interior facing scoop surface and exterior facing scoop surface constructed to shove food portions pushed thereagainst onto the eating utensil.

In another embodiment, the assisted eating aid includes at least one partition dividing the centrally disposed food receiving region into a plurality of food receiving compartments with at least one flange disposed in each food receiving compartments.

Other features of the embodiments constructed in accordance with the principles of the present invention involve the incorporation of transparent flanges or scoop obstacles, spaced apart flanges of varying heights and widths, and fixed or integrally formed flanges.

An assisted eating aid constructed in accordance with the principles of the present invention overcomes the problems associated with prior art by providing an individual with a decidedly advantageous near-normal, self-assisted dining experience by using an easy to use serving vessel that is supportive, handy, effective, functional and visually appealing to, among others, the elderly and those with physical impairments, as well as providing an assisted educational aid for toddlers during mealtime.

The embodiments described herein in accordance with the principles of the present invention may be constructed or formed through modem means by incorporating integral flanges protruding upwardly and, in some cases, inwardly, and including but not just limited to incorporating an arcuate outward and upward bend all having various heights and various flange angles encompassing fully or partially the eating vessel perimeter with sectional or non-sectional flanges having a measurement along the flange base that is less than the outer measurement of that of the eating vessel perimeter, thus providing flanges of different shapes, angles, and heights where food can be pressed against in an effort to assist in the proper and successful loading food onto an eating utensil.

As one feature of the present invention, a secondary back up catch system may also be provided in the form of an area extending outside the flange base yet within the eating vessel perimeter as a catch ledge further preventing food that breaches the top of the flange from exporting onto the table or floor.

Further, the present invention provides for a detachable movement resistant component, or for the incorporation of an added attachable movement resistant component affixed by various means necessary to secure it to the bottom of the eating vessel and being shaped in the form of, but not just limited to, one or more integrally formed concentric rings either encircling the entire vessel bottom or sectioned apart by the underside void of the internal partitions or by having multiple continuous concentric rings circumventing the entire vessel bottom, or by providing multiple smaller concentric formed rings placed in numerous areas along the bottom of the vessel, each type having a vacant parcel between the concentric rings where a movement resistant material could be molded with, inserted in, or attached to either temporally or permanently by various means thus providing a movement resistant system between the eating vessel and the surface where it sits.

Further, removable coverlids of various similar shapes of the underlying vessel and having internal heights necessary to accommodate the elevation of the flange components within the coverlid interior could be a beneficial addition for maintaining food temperatures while the loaded vessel is in transit or while the vacant vessel is in storage.

Additional benefits to the present invention are to provide an eating vessel that is visually authentic, of sufficient size, inexpensive to manufacture, environmentally safe, easy to clean, sanitary and simple to use by everyone from toddlers to the elderly, including those individuals stricken by minor disabilities and even those that may be afflicted with major physical impairments as a result of accident or war.

The current invention would be of greatest significance for certain individuals and caretakers that provide for the elderly, and it would be especially cost effective for businesses that care for individuals living with physical impairments brought by disease or injury. Additionally, the current invention would provide a functional assisted eating aid that physically impaired individuals could use without eating assistance from others during a rehabilitation process, freeing up the highly trained professionals to better assist and serve those individuals that have much greater needs. Additional significance applies when the considering high cost of non-ambulatory care today. The basic tenet of the highest and most efficient allocation of human recourses will result in more efficient increased productive allocation of available man hours that inevitably leads to improved services, provided at a lower cost, to the institutions and to the individuals they care for.

The objectives of the present invention are to:

1) Provide an assisted eating aid that is inconspicuous for the independent user during its application;

2) Provide an assisted eating aid that is that is supportive, handy, effective, functional, and appealing;

3) Provide an assisted eating aid that promotes self-reliance, dignity, and pride for the end user;

4) Provide an authentic near-normal dining vessel, authentic in appearance and incorporating the advantages of a self-assisted eating aid;

5) Provide an assisted eating aid that promotes the successful recurrent muscle memory during a physical rehabilitation process through the reparative success of the individual's operative interaction with the device;

6) Provide a new and improved eating aid that promotes independent use for an adaptable dining experience at mealtime;

7) Provide an eating aid with an unobstructed view into the device;

8) Provide functional near-normal, assisted eating aid for the independent education of toddlers during mealtime;

9) Provide an assisted eating aid that is easy to use with minimal effort;

10) Promote a conventional dining experience for those requiring various assistive needs;

11) Provide an assisted eating aid that advances freedom from embarrassment while dining with an assistive device;

12) Provide an assisted eating aid that complements successful ergonomic body movements during use;

13) Provide an assisted eating aid that promotes operative interaction with various types of foods comprised of different textures, size, consistency, density, and weight;

14) Provide a modern means of manufacture for such assisted eating aid;

15) Provide an assisted eating aid that is comprised of a composition of materials that allows the device to withstand the rigors of mechanical dishwashers, sterilizers and microwave ovens;

16) Provide a singular multi-functional assisted eating aid for toddlers and the elderly alike;

17) Provide an assisted eating aid that is durable;

18) Provide an assisted eating aid that is unique in its operation, yet easily understood by individual user;

19) Provide an assisted eating aid that functions with the use of only one limb;

20) Provide an assisted eating aid that is stable during use yet versatile enough for the individual to move during use;

21) Provide an assisted eating aid that can adapt to multiple ergonomic movement resistant applications;

22) Provide an assisted eating aid that incorporates both a primary and a secondary means of preventing the accidental discharge of food onto the table or floor;

23) Provide an assisted eating aid that is operative with the interaction between the dish, the food, and the eating utensil;

24) Provide an assisted eating aid that is interactive and adaptive to various assisted dining requirements;

25) Provide an assisted eating aid that is inexpensive to produce;

26) Provide an assisted eating aid integrally formed with no moving parts;

27) Provide an assisted eating aid that is easy to clean by either mechanical means or hand washing; and/or 28) Provide an assisted eating aid that is sturdy and unbreakable.

It will be appreciated that all of the exemplary objectives listed herein are not required to be met by the present invention or any embodiments described herein and that a smaller subset of such objectives may be met by any such embodiments described herein. Furthermore, it is an object of this application to illustrate the preferred embodiments and broadly state the methodologies that may be used in order to provide an individual's accompanying needs with a decidedly advantageous, authentic replica of a normal dining vessel that incorporates the advantages of a fully functional self-assisted eating or educational aid.

DETAILED DESCRIPTION OF THE PREFERRED EMBODIMENTS

In the description below, it will be appreciated that like components in different embodiments may be numbered alike.

Figure 1:
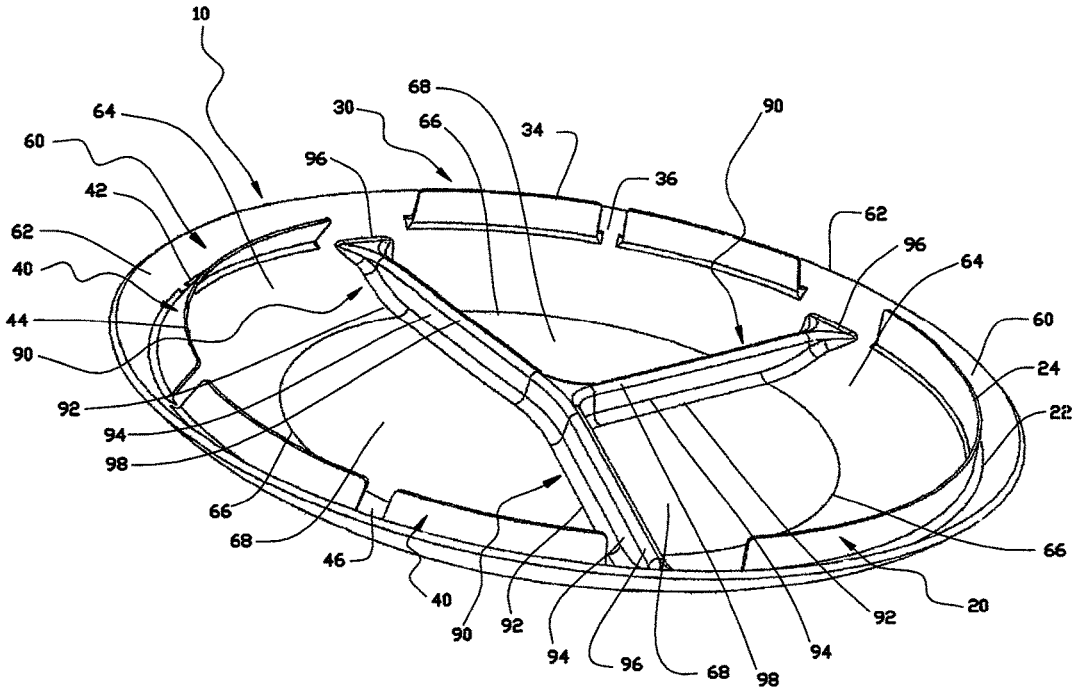
FIG. 1 is an upper, right perspective view of an exemplary assisted eating aid constructed in accordance with the principles of the present invention.

Turning now to FIG. 1 an exemplary assisted eating aid, generally designated 10, is depicted as a serving vessel incorporating a number of integrally formed flange components (or scoop obstacles or scoop abutments) generally designated 20 (single elongated), 30 (set of two spaced apart flanges more closer to right angle projection), and 40 (set of four spaced apart flanges with a more acute angle projection), some of which protrude upward vertically while others protrude upwardly and inwardly relative to the center of the vessel. These flange components 20, 30, and 40 may have various heights and be attached at various angles generally intersecting an arcuate upward flexure integrally formed outer ring 64 commencing from the intersecting bottom outer measurement 66 that intersects a flat surface 68 having integrally formed upward protruding internal partition components 90, useful for separating food into groups. A gap 36 is used to separate the two flanges of flange group 30 while a set of gaps 46 is used to separate the flanges of flange group 40.

The flat surface 68 provides the main food placement surface of the assisted eating aid 10. The partitions and flat surface generally cooperate to form separate food compartments, three in this example. In this first exemplary embodiment of FIG. 1, the flange components 20, 30, and 40 typically have a height range of 0.82 inches to 1.0 inches measured from the adjacent top surface of assisted eating aid 10. The flange components 30 and 40 have a width of 2.32 inches while an elongated flange component 20 has a width of 11.0 inches. Neither of these height or width dimensions is meant to be limiting and the flange component heights and widths may vary around the circumference of the assisted eating aid 10. Moreover, the angle of projection of the flange components may generally range from a 90 degree angle relative to the adjacent serving surface to a more acute angle relative to the upwardly curving outer ring 60. A range of angles from 45 degrees to 90 degrees has been found suitable for purposes of satisfying one or more of the objectives of the assisted eating aid 10 but is not meant to me limiting.

In most instances, it is preferred to angle the flange components 20, 30, and 40 at least slightly inwardly generally toward the center of the flat surface 68. The flange components may be transparent so as to allow the user to easily see through the flange to the food beyond eliminating much of the obstruction issues in the prior art. As the flange components are preferably integrally formed, they are also fixed in place and avoid the pivoting problems with some of the prior art baffle components.

It will be easy to see that with little modification any vessel 10 shape, such as, but not just limited to, ovals, squares, or even triangle shapes, may be used. Moreover, the vessel may incorporate, but not be limited to, flat bottom surfaces or those with added arcuate sides or flexure components, and can easily incorporate any upward protruding internal partitions 90 consisting of various shapes and heights and also incorporating any of the various flange component 20, 30, and 40 configurations.

Still referring to FIG. 1, a secondary back up catch system in the form of an extended ledge 60 laying outside the flange base 22 includes an outer diameter measurement greater than the flange base 22 (or 42 for flange 40) and less than the outer measurement of the perimeter 62 to provide the secondary catch ledge 60 necessary to further prevent food that breaches the summit 24 of flange 20, summit 34 of flange 30, or summit 44 of flange 40 from exporting on the table or floor. This ledge 60 forms a food spill region or spillover region. This ledge may project horizontally or angle upwardly to inhibit food from sliding off. FIGS. 19-23 show various alternative catch system and ledges and will be discussed further below.

In addition, the assisted eating aid 10 may include integrally formed internal partition components 90 consisting of upward and inward sides 94 and commencing at the intersection 92 with the bottom 68 and terminating at their summit 98. Such partitions extend from the center of the assisted eating aid into the secondary food receiving area 64 and assist in separating out food groups within the primary food receiving area 68 and secondary food receiving area 64.

Figure 2:
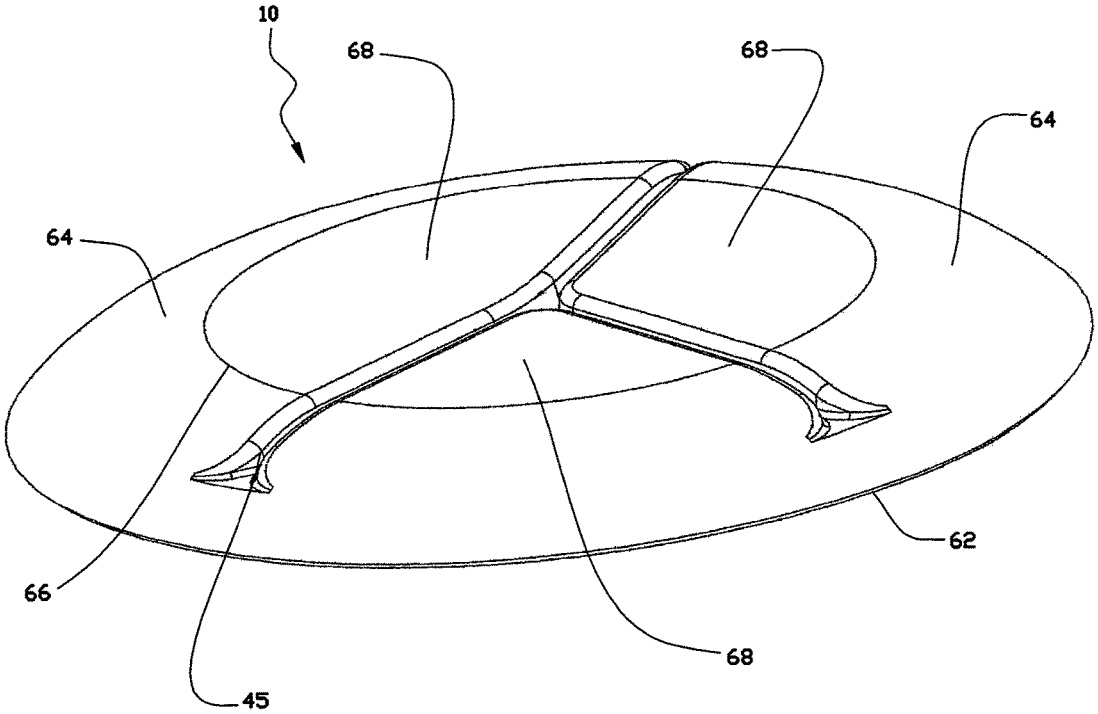
FIG. 2 is an upper, right perspective view of the bottom surface of the assisted eating aid of FIG. 1.

Referring now to FIG. 2, the bottom central underside 68 of the assisted eating aid 10 includes an arcuate downwardly formed outer ring 64 projecting from the intersecting outer measurement 66 of the flat bottom 68. Recesses 45 to lighten the overall weight of the assisted eating aid are present in the undersurface of the plate 10 where the partitions 90 reside above (FIG. 1). In this embodiment, it will be appreciated that the bottom surface 68 of the assisted eating aid 10 is not an essential feature of the present invention and may take many forms, including those that facilitate stacking.

Exemplary Method of Use

Figure 3:
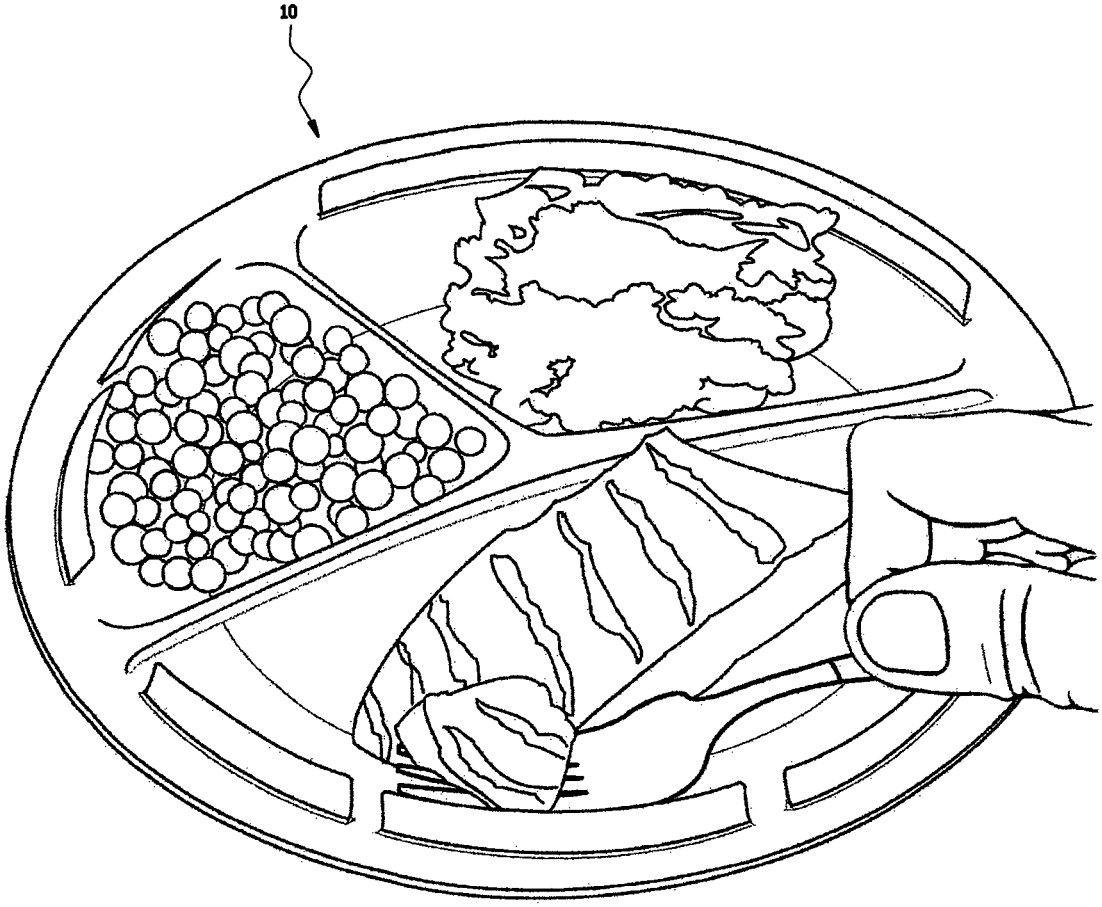
FIG. 3 is an upper, right perspective view showing how the exemplary assisted eating aid of FIG. 1 in may be used.

Referring now to FIG. 3, the assisted eating aid 10 may be used to educate toddlers as well as accommodate the elderly in need of feeding assistance and those with physical impairments requiring assistance. For example, the assisted eating aid depicted in FIGS. 1-3 may be used for placing food into the three separate compartments or tray sections divided by the partitions 90. A user may then grasp a utensil such as a spoon or fork by scooping underneath the selected food item within a compartment and moving the utensil with a portion of the food toward an adjacent flange component 20, 30, or 40 so that the food encounters the upwardly projecting flange component, the food will be driven onto the utensil to reside thereon. The user may then raise the utensil up to his or her mouth to complete the feeding step.

It will be appreciated that different flange 20, 30, or 40 heights may be used to accommodate different types of food and that the flanges provide interior and exterior food loading surfaces for use in cooperating with an eating utensil used for loading and carrying food. For example, creamier foods that generally lay flat on the plate may not need a flange with much height or inward angle while pieces of meat or cut vegetables may need a higher flange. However, whatever the height of the flange, it is preferred to construct or form them as transparent fins so that they do not obstruct or hide the view behind them. This allows the user to accurately gauge the movement of the utensil and interaction of the food with the flange to reduce the likelihood of scooping too little a quantity. The transparency also assists in making the assisted eating aid resemble a more conventional plate as well.

For food that falls over the summits 24, 34, 44 and outside the respective flange components 20, 30, or 40 perimeter and onto the secondary catch all area 60 it will be appreciated that the user may simply reverse the motion of the utensil by pushing away toward the flange component and along the catch all ledge 60 to reintroduce the catch all food back onto the utensil or up and over the flange component and back into an interior section 68 of the assisted eating aid 10.

Exemplary Method of Manufacture

Referring now to FIG. 1, the assisted eating aid 10 may be constructed with integrally formed flange components 20, 30, and 40, (See FIG. 1, and FIG. 19 through FIG. 24) shown in various forms protruding upward to their summit and in some cases inward, incorporating various shapes including but not just limited to forms that are arcuate outward or inward, vertical, angular, or upward flexures (See FIG. 1 and FIG. 19 through FIG. 24). Flange components 20, 30, and 40, comprised of various heights 24, 34, 44, respectively, in some cases having flange partitions 26, 36, and 46, respectively, integrally formed either fully or partially encompassing the inner perimeter 22, 32, and 42, respectively, (See FIG. 1 through FIG. 11) of the vessel 10 forming an integral integration with a measurement along the flange base 22, 32, or 42, respectively, that is less than the outer measurement of the of the perimeter 62 (See FIG. 1 and FIG. 19 through FIG. 24).

With continuing reference to FIG. 1, the assisted eating aid 10 is additionally constructed to provide a secondary back up catch system in the form a ledge 60 (See FIG. 1, and FIG. 19 through FIG. 24) lying outside the flange component base 22. The catch ledge 60 comprised of various shapes (See FIG. 19 through FIG. 24) formed within the perimeter measurement between the flange base 22 and the outer measurement of the perimeter 62 providing an additional backup system further preventing food from exporting on the table or floor. Additionally, the present invention 10 is made by incorporating integrally formed internal partition components 90 of various heights and various shapes protruding upward from the bottom 68, terminating vertically at their summit 98 and terminating laterally intersecting 96 with the arcuate side 64 (See FIG. 1), or intersecting 396 the flange component 20 and 40 (See FIG. 8, and FIG. 9). Removable cover lids 900 (See FIG. 24 and FIG. 25) of various perimeter shapes formed to correspond to the various shaped eating vessel (see FIG. 1 through 11) and having internal heights necessary to accommodate the elevation of the flange components 20, 30, and 40 and yet rest comfortably outside the measurement along the flange base 22, 32, and 42, respectively, resting on the ledge 60 and inside the outer perimeter 62 could be added.

Figure 17:
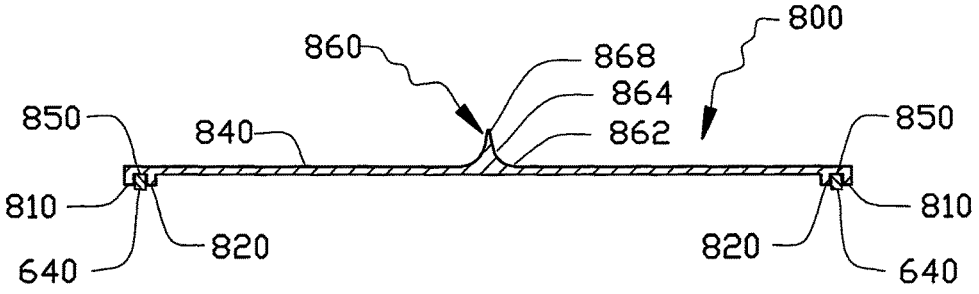
FIG. 17 is a sectional view taken along lines 17-17 of FIG. 16.
Figure 18:
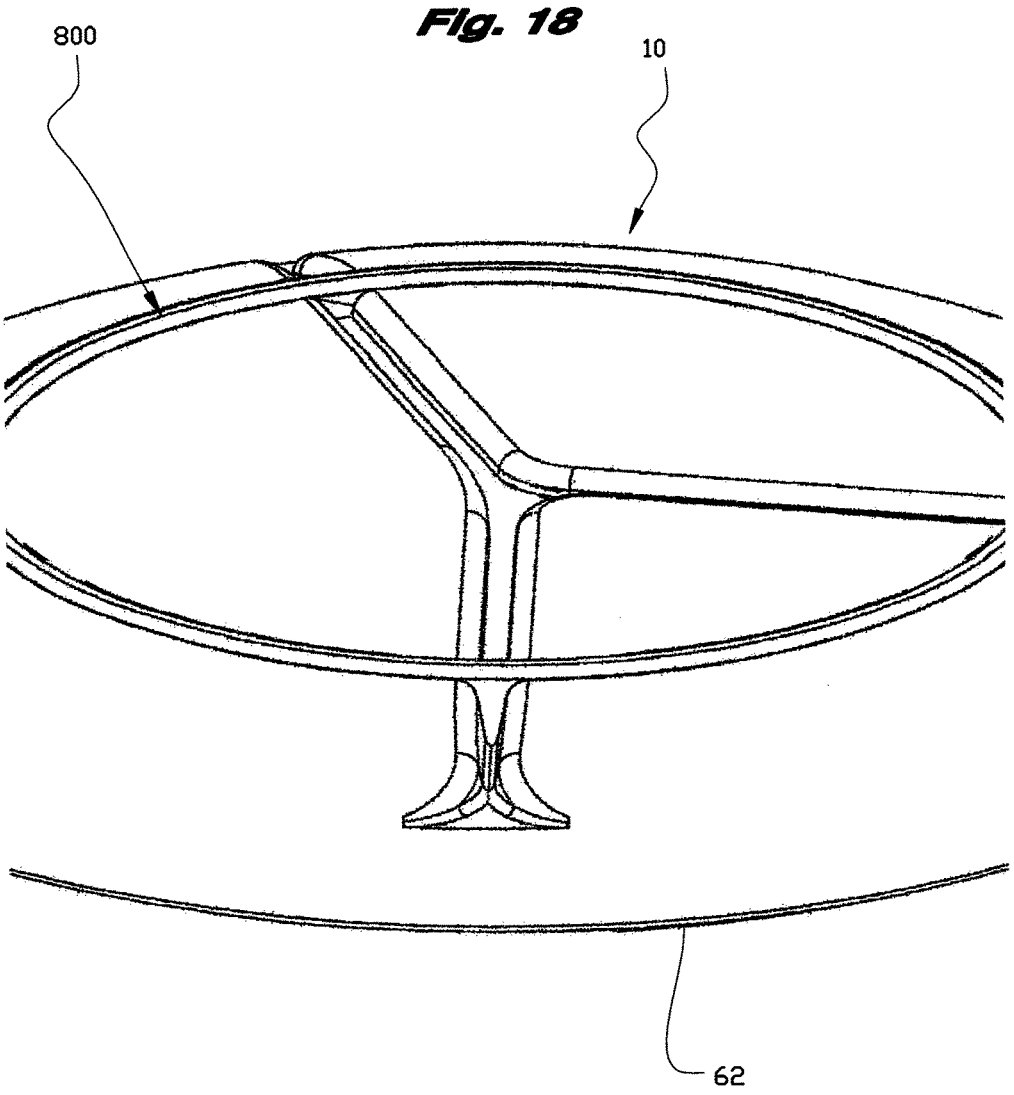
FIG. 18 is a partial sectional view depicting an exemplary variation to that shown in FIG. 16 and in accordance with the principles of the present invention.

Furthermore, movement resistant systems may be integrated into the underside bottom 68 (FIG. 2) by incorporating including but not just limited to, movement resistant component 600, 700, or 800 (FIGS. 5, 7, 9, 13, 15, 17, and 19-23) each comprised of various forms of concentric rings attached to the vessel in various fashions producing a movement resistant component that provides a means to confine a movement resistant material 640 inserted within the vacant parcels 630, 730, 830 (See FIG. 12 through FIG. 17), or molded through various means to the vessel (See FIG. 18). A detachable movement resistant component 800 (See FIG. 16 and FIG. 17) could also be used. Additionally the present invention, or any of the related integrally formed movement resistant systems 600, 700, or the related detachable movement resistant system 800 or any related coverlid components 900 are constructed to allow for production in any color or graphic design, in combinations by and of various thickness, sizes and shapes employing any number of various molding technologies such as by but not just limited to ceramic molds, sand casting, pressed molds and even injection molding processes using materials of various types such as but not just limited to clay, porcelain, fused dissolved silica and silicates products, metals, melamine, thermoplastic vulcanizates, and other plastics or even various fibrous products.

Alternative Embodiments

Figure 4:
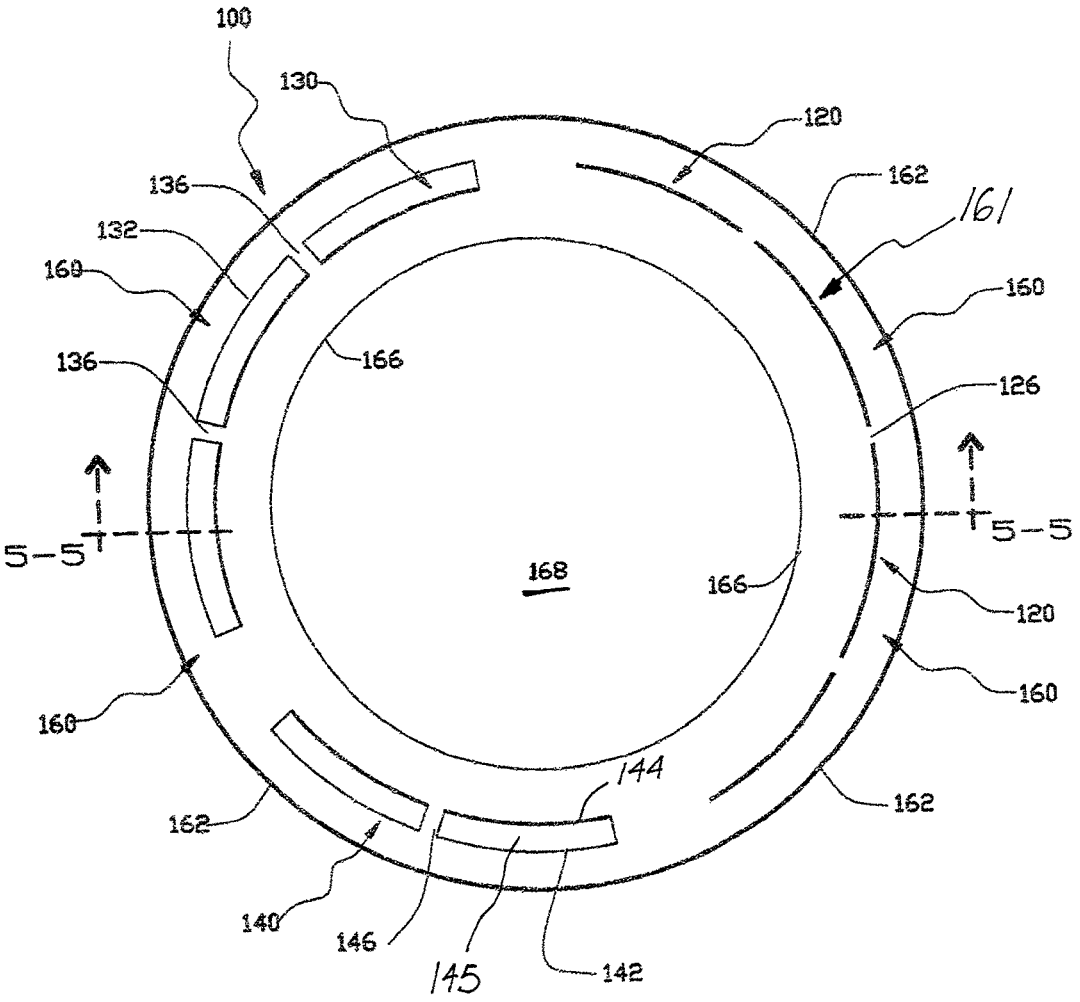
FIG. 4 is a top view of an exemplary second embodiment constructed in accordance with the principles of the present invention.
Figure 5:
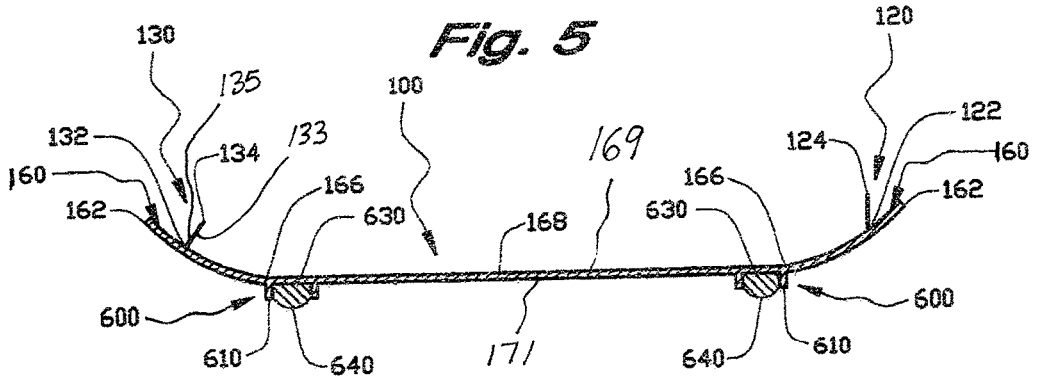
FIG. 5 is a sectional view taken along lines 5-5 of FIG. 4.

Referring now to FIGS. 4-5, another exemplary assisted eating aid, generally designated 100, is illustrated. As with the prior exemplary embodiment 10, the assisted eating aid 100 is provided by a food serving vessel, such as a plate, dish, bowl, or tray, for self-assisting a user in loading or directing food onto an eating utensil such as a fork or spoon using a generally single direction hand motion. The assisted eating aid 100 is generally defined by a central circular bottom region 168 (FIGS. 4-5) with a flat upper surface 169 and an opposing flat bottom surface 171 as best shown in FIG. 5. The central circular bottom region defines a main food placement surface extending to circumferential dividing line 166 or outer measurement of the circular bottom region. Extending outwardly and upwardly from the circumferential dividing line 166 to terminate at an outermost perimeter 162 of the assisted eating aid 100 is an arcuate side, generally designated 160, defining an annular region circumscribing the circumferential dividing line 166 as best shown in FIG. 4. As further depicted in FIG. 5, the outermost perimeter 162 of the arcuate side 160 terminates at a point higher than the upper surface 169 of the bottom 168. Within the annular region 160, three discrete sets of flange components, generally designated 120, 130, and 140, are disposed. The first set of flange components 120 includes a set of four flanges located on the right half of the assisted eating aid 100 as shown in FIG. 4. As shown in FIG. 5 by an exemplary flange and the overhead view in FIG. 4, these four flanges project vertically upwardly from their respective bases (such as 122 in FIG. 5) which abut the arcuate side 160. The four flanges are disposed in a location recessed from the outermost perimeter 162 and exterior to the circumferential dividing line 166 within the annular region 160. In this exemplary embodiment 100, the uppermost edge or summit of the flanges 120 is a constant height from where the flanges project from the annular region 160 as indicated at 124 in FIG. 5 for example, and sweeps through the same radius of curvature as the outer perimeter 162 of the annular region 160 when viewed from above as in FIG. 4. Each flange within this first set of flange components 120 is spaced apart from an adjacent flange as, for example, indicated at gap 126, and generally follow the curvature of the annular region as viewed from above (FIG. 4). The second set of flange components, generally designated 130, includes a set of three flanges disposed on the left side of the assisted eating aid 100, also within the annular region 160 recessed from the outermost perimeter 162 and exterior to the circumferential dividing line 166. Unlike the flange components 120, the flange components 130 project upwardly and inwardly from their respective base, such as 132 in FIG. 5 which abuts the arcuate side 160, to project toward the bottom 168. The uppermost edge or summit of each of the flange components 130 is a constant height from the annular region 160 as, for example, indicated at summit 134 in FIG. 5 and generally follows the contour of the annular region 160 when viewed from above as in FIG. 4. As shown in FIG. 5, the uppermost edge 124 of flange components 120 is higher than the uppermost edge 134 of flange components 130 relative to the upper surface 169 of the central bottom region 168. Like the first set of flange components 120, the second set of flange components 130 are also spaced apart from adjacent flanges as, for example, indicated at gap 136 and generally follow the curvature of the annular region 160 as viewed from above (FIG. 4). The third set of flange components, generally designated 140, includes a set of two flanges that are also located on the left side of the assisted eating aid 100 and also within the annular region 160 recessed from the outermost perimeter 162 and exterior to the circumferential dividing line 166. Like the flange components 130, the flanges in this third set of flange components 140 also project upwardly and inwardly from the annular region 160 from their respective bases, such as base 142 in FIG. 4, toward the bottom 168. The innermost and uppermost edge, such as 144 in FIG. 5 for example, of each flange component 140 is of constant height from the base of each flange and generally follows the contour of the annular region as shown in FIG. 4. The flange components 140 are also spaced apart with a gap indicated at 146 and generally follow the curvature of the annular region 160 as viewed from above (FIG. 4). The flange components are integrally formed along the arcuate side 160 that commences at the outer measurement 166 of the bottom 168. As further shown in FIGS. 4-5, the annular region 160, which circumscribes the entire perimeter of the circumferential dividing line 166 of the central bottom region 168, includes an outer annular region that defines a catch-all region or outer ledge 161, which extends from the exterior food loading surface of each flange, such as exemplified by 135 in FIG. 5 on flange components 130 extending between the base 132 and the summit 134, to the outermost perimeter 162 of the assisted eating aid 100. The flange components 120, 130, and 140 are spaced concentrically about the annular region 160. As explained above in the method of using the previous embodiment shown in FIGS. 1-3, the incorporation of the inwardly projecting flange components 130, 140 act as an outward movement barrier or stop as the user scoops a portion of food with an eating utensil, such as a fork or spoon, along the upper surface 169 of the bottom 168 and into the annular region 160 into contact with an interior facing food loading surface of a flange component 120, 130, or 140, such as exemplified by 133 of flange components 130 in FIG. 5 extending between the base 132 and summit 134. The interior facing food loading surface of a flange prevents the portion of food from being further withdrawn along the upper surface of the annular region 160. As the user continues to scoop food toward the interior food facing scooping surface, the portion of food will be directed on the eating utensil by the flange. While both sets of flange types (120 or 130/140) facilitate this process, the inwardly projecting angle of flange components 130, 140 better ensures that the food portion will be directed back onto the eating utensil. The user may then continue sliding the utensil upwardly against the interior facing food scooping surface and raise the utensil up past the top edge of the corresponding flange component and up to their mouth to complete the feeding step. For those food portions that may fall over the summits or top edges 124, 134, 144 of a flange component and outside the respective flange components 120, 130, or 140 and onto the secondary catch all area 161 it will be appreciated that the user may simply reverse the motion of the utensil by pushing away from the outermost perimeter 162 and toward the exterior facing food loading surface of the nearest flange component, such as exterior facing food loading surface 135 in FIG. 5, and along the catch all ledge 161 to reintroduce the catch all food back onto the utensil or, alternatively, up and over the flange component and back into bottom region 168 of the assisted eating aid 100 where the process of directing food toward an interior facing food loading surface may be repeated. It will be appreciated that the inward sloping flange components 130, 140 facilitate the process of reintroducing food portions from the catch all region 161 into the central bottom region 168 somewhat better than the straight up vertically projecting flange components 120. In this exemplary embodiment 100, the upward protruding internal partition components 90 as shown in FIG. 1 have been eliminated leaving the bottom 168 flat within the measurement of the area encompassed by circumferential dividing line 166. The underside 171 of the bottom 168 may be the integrally formed with a movement resistant component 600 (FIG. 5) with a channel 610 incorporating a movement resistant material 640 such as those sold under the Santoprene™ brand name set into the provided vacant parcel 630 as shown in but not just limited to FIG. 4 through 9, and FIG. 18 through FIG. 24. As shown in FIG. 5, it will be appreciated that the movement resistant material 640 includes a lowermost surface that extends outside the channel 610 to make contact with an underlying support surface that the assisted eating aid 100 may be placed upon. Such movement resistant material is useful in resisting sliding or twisting motions of the serving vessel 100 relative to an underlying support surface during use.

Figure 6:
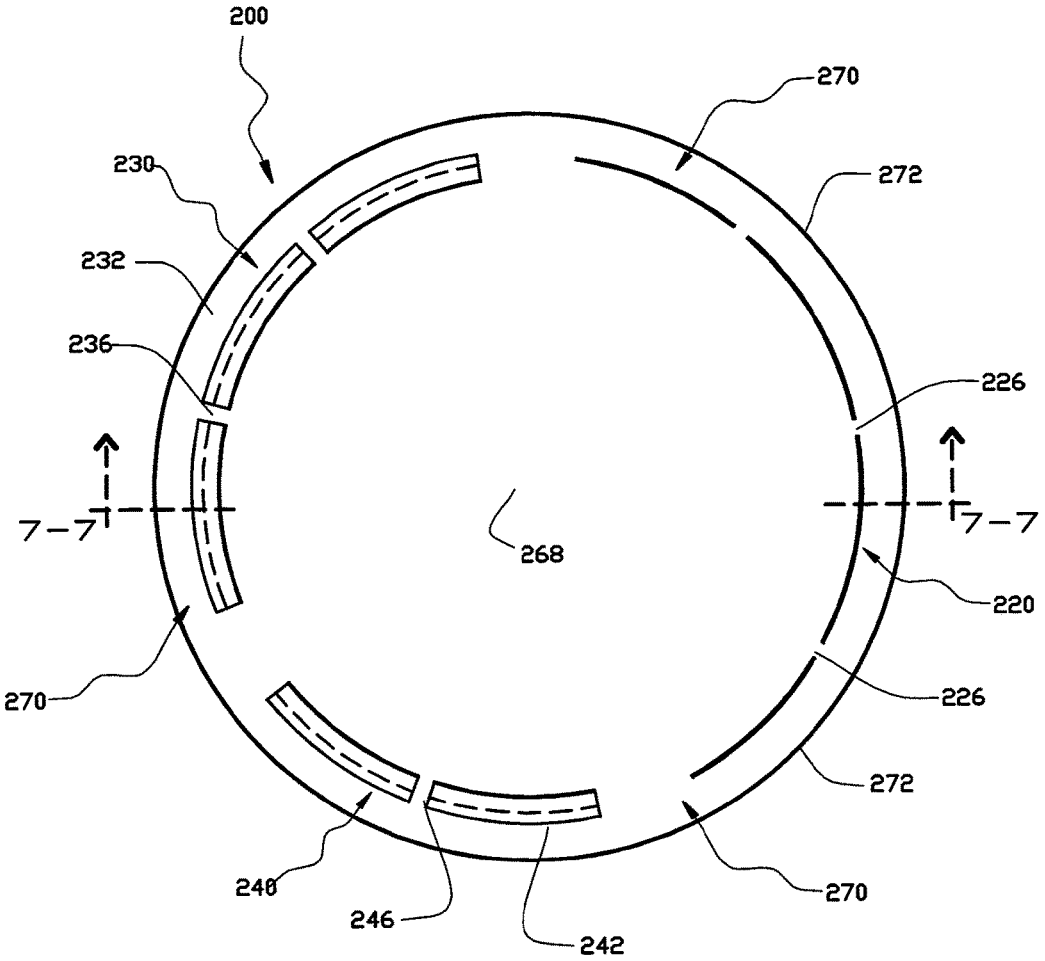
FIG. 6 is a top view of a third exemplary embodiment constructed in accordance with the principles of the present invention.
Figure 7:
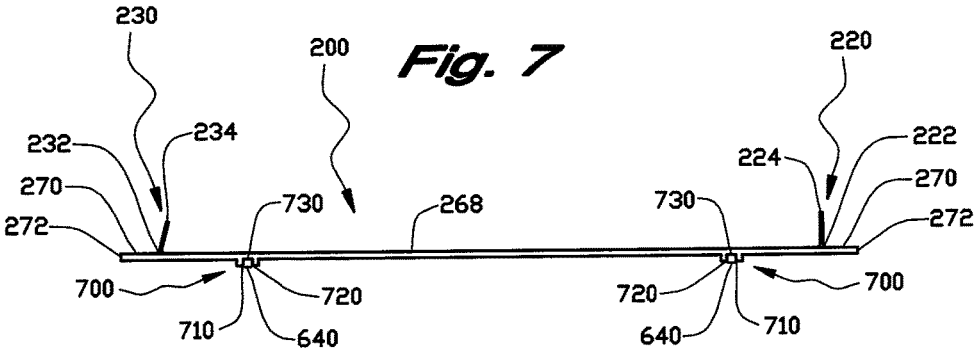
FIG. 7 is a sectional view taken along lines 7-7 of FIG. 6.

Turning now to FIGS. 6-7, another exemplary embodiment of the assisted eating aid, generally designated 200, is depicted with flange components 220, 230, and 240 and further illustrating a variation in the bottom surface 268 by also eliminating the upward protruding internal partition components 90 and the arcuate side 60 (from FIG. 1) leaving an uninterrupted flat bottom 268 within the area encompassed by the measurement of the outer perimeter 262. In addition, the flange components 20, 230, and 240 are shown projecting both vertically and in an inwardly sloping direction. The fully detailed flat bottom 268, the secondary ledge 260, and the movement resistant component 700 (FIG. 7) integrally formed on the underside of the bottom 268 incorporating the movement resistant material 740 set into the provided vacant parcel 730 as described in but not just limited to FIG. 7, FIG. 9 and FIGS. 14-15 and FIG. 16 and FIG. 18 may also be incorporated into this embodiment.

Figure 8:
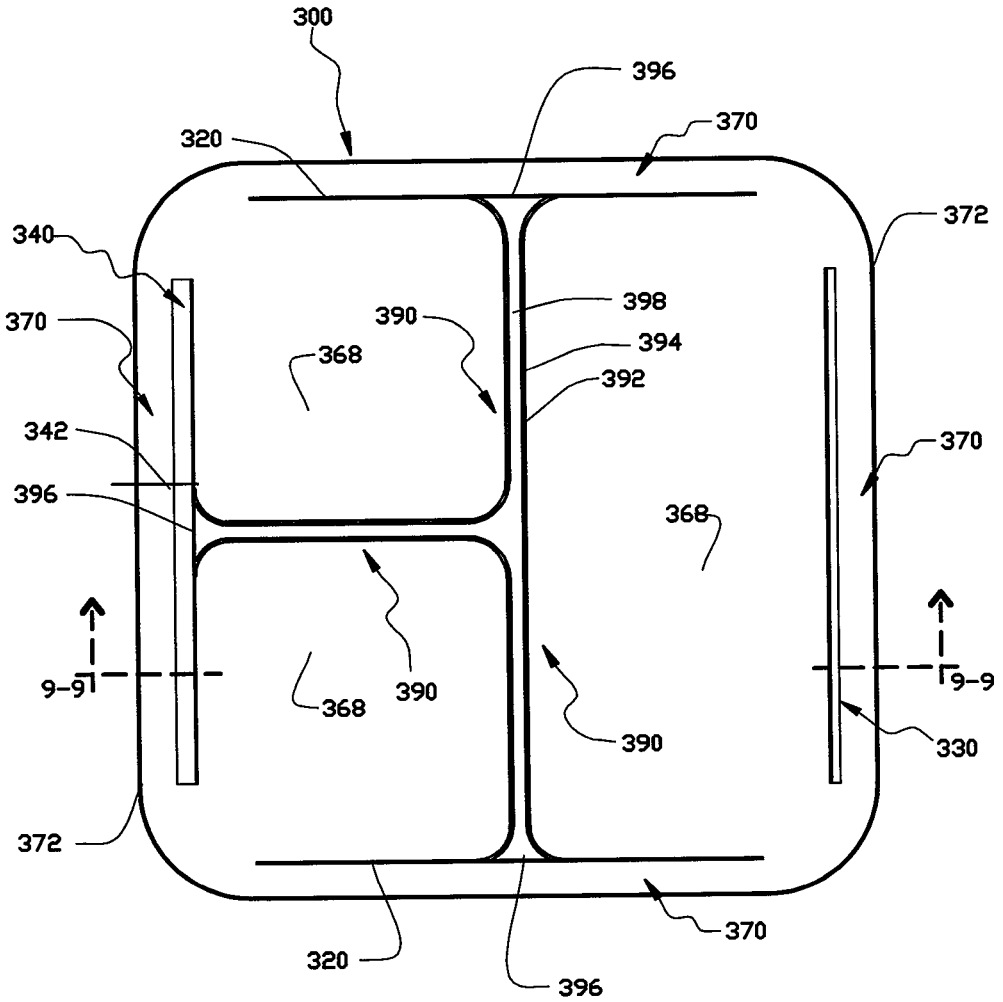
FIG. 8 is a top view of another exemplary embodiment of an assisted eating aid constructed in accordance with the principles of the present invention.
Figure 9:
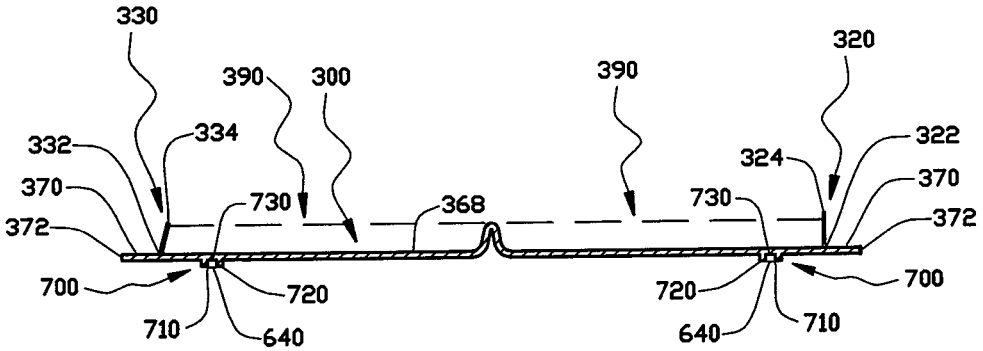
FIG. 9 is a sectional view taken along lines 9-9 of FIG. 8.

Referring now to another alternative embodiment of an assisted eating aid, generally designated 300, as shown in FIGS. 8-9, the integrally formed eating vessel incorporates a variation, from earlier versions of the assisted eating aid 10, 100, and 200 described above, in the overall outer shape and incorporating various integrally formed flange components 320, 330, and 340 illustrating a variation in the bottom surface 68 of FIG. 1 and eliminating the arcuate side 64 of FIG. 1 leaving an uninterrupted flat bottom 368 within the area encompassed by the measurement of the outer perimeter 372 and having internal partition components 390 of various heights and various shapes consisting of but not just limited to those protruding upward having a rounded top 398 and inward protruding sides 394 commencing at the intersection 342 with the bottom 368 and traversing laterally terminating at an interior intersection 396 with any of the various flange components 320, 330, and 340 as described in but not just limited to the flange component embodiments described in FIG. 1, and FIG. 19 through FIG. 24.

Figure 10:
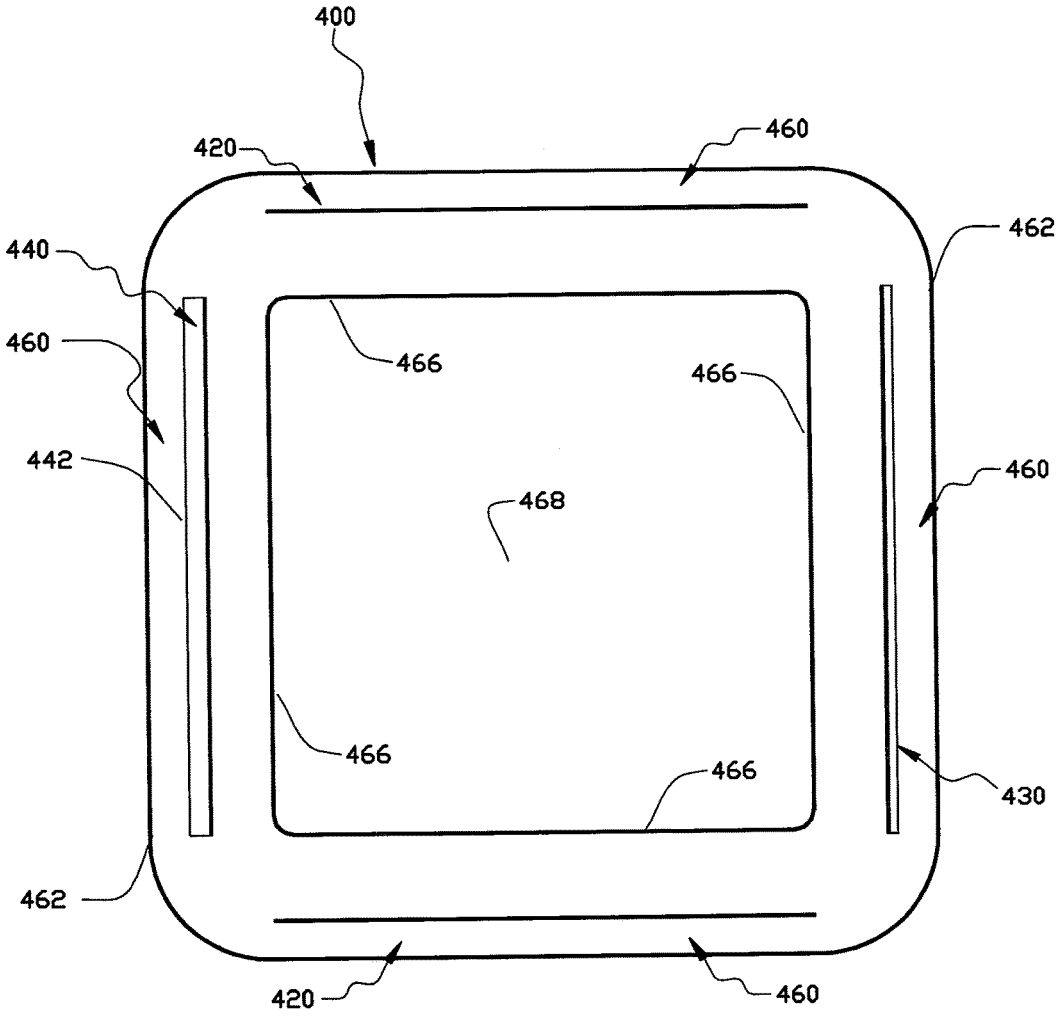
FIG. 10 is a top view of another exemplary embodiment of an assisted eating aid constructed in accordance with the principles of the present invention.

Referring now to FIG. 10, another exemplary embodiment of an integrally formed eating vessel, generally designated 400 is shown with an overall square profile when viewed from above. The upper surface incorporates in but not just limited to the embodiments described in FIG. 4 and FIG. 5.

Figure 11:
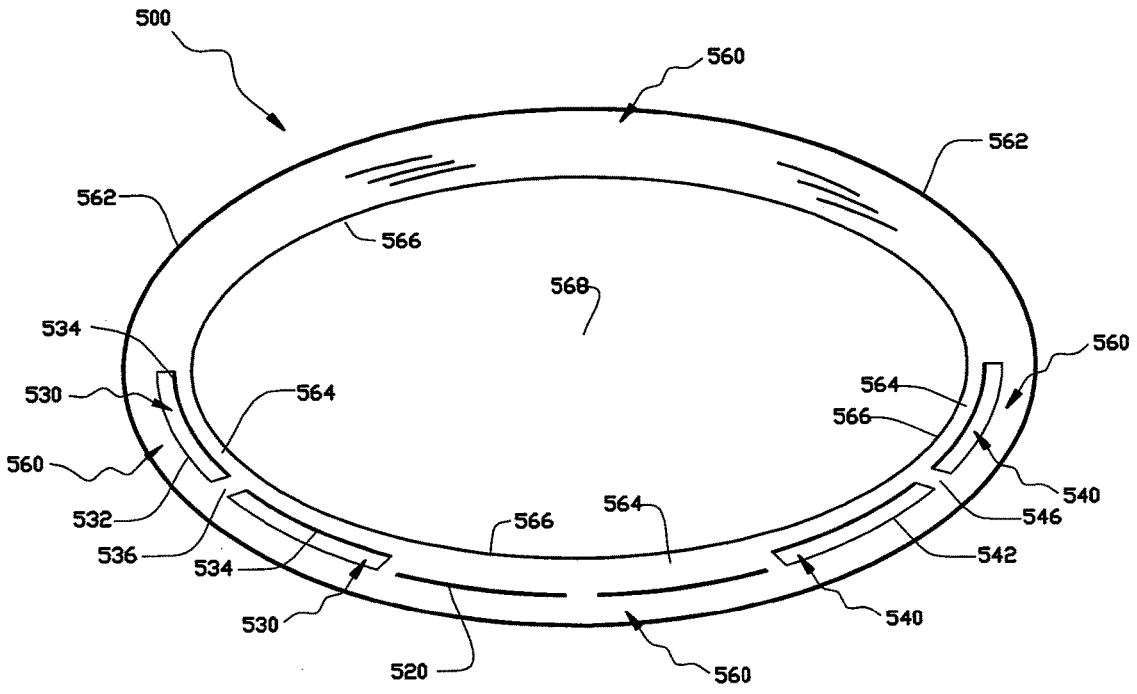
FIG. 11 is a top view of another exemplary embodiment of an assisted eating aid constructed in accordance with the principles of the present invention.

Turning now to FIG. 11, another exemplary embodiment of an integrally formed eating vessel, generally designated 500, illustrates a variation in the overall outer shape of the eating vessel with flange components 520, 530, and 540 comprised of various heights 534 of flange 530 for example in some cases having flange partitions 536 and 546 for example, integrally formed in this case partially encompassing the vessel perimeter creating an integral integration with a measurement along the flange base 532 for example that is less than the outer measurement of the of the perimeter 562.

Figure 12:
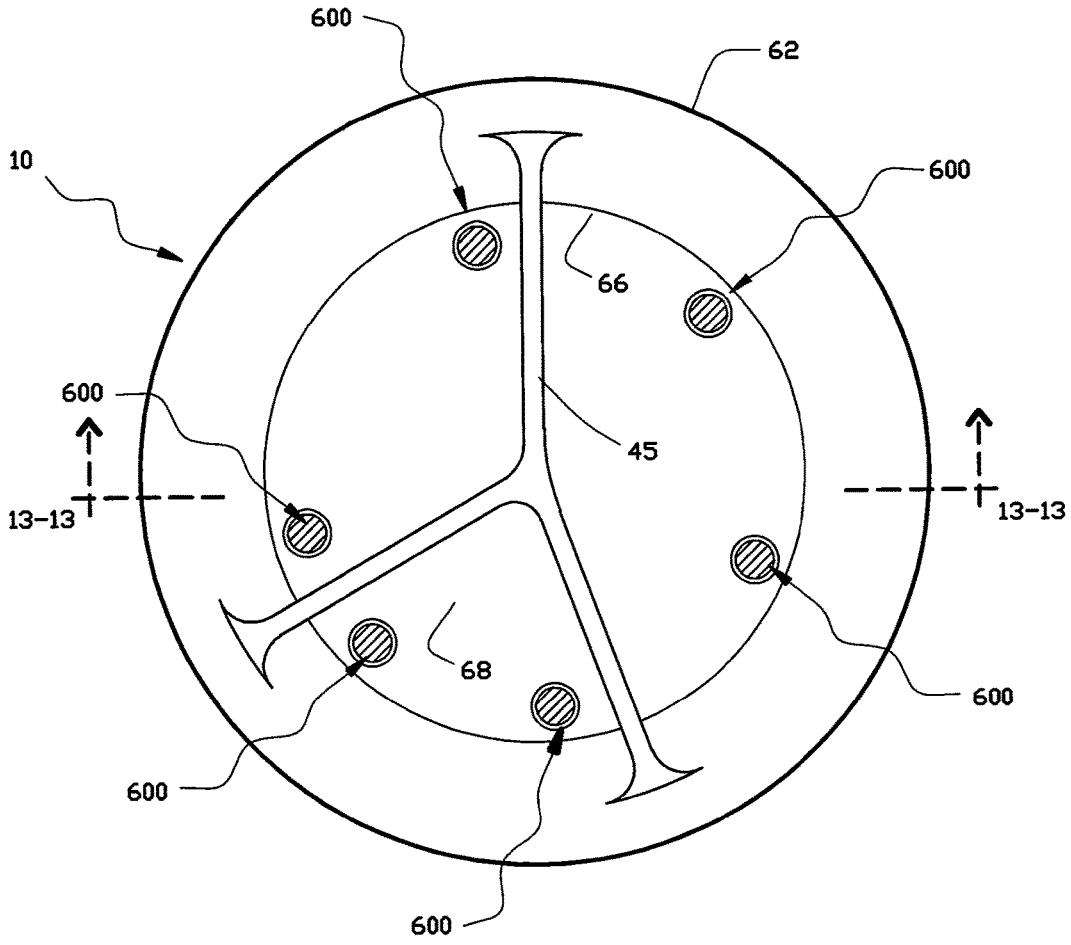
FIG. 12 is a bottom view of a fourth exemplary embodiment constructed in accordance with the principles of the present invention.
Figure 13:
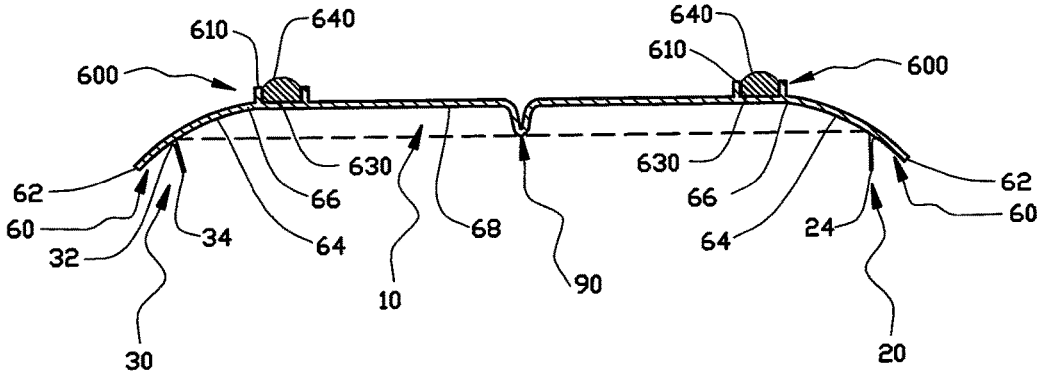
FIG. 13 is a sectional view taken alone lines 13-13 of FIG. 12.

As shown in FIGS. 12-13, yet another alternative embodiment of the assisted eating aid, generally designated 10, is presented with an underside of the bottom 68 having an integrally formed movement resistant component 600 positioned in numerous locations between the internal partition components 90 within the outer measurement of the underside of the bottom 68 and being comprised of protruding multiple concentric rings 610 housing a recessed vacant parcel 630 for the insertion of a movement resistant material 640 attached either temporarily or permanently by various means and being of various cross sectional shapes including but not just limited to square, or rounded and having a height greater than the protruding concentric rings 610 as a means of providing a movement resistant barrier between the eating vessel 10 and the surface where it sits.

Figure 14:
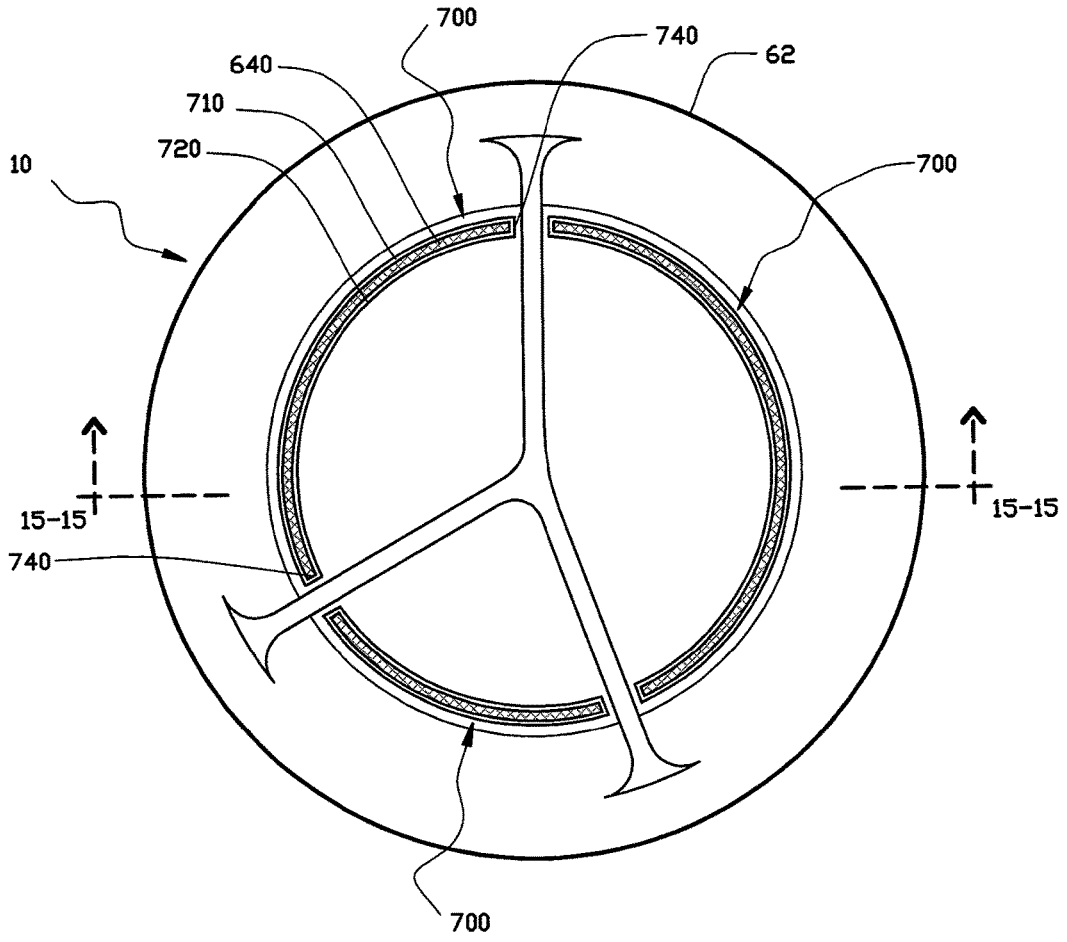
FIG. 14 is a bottom view of a fifth exemplary embodiment constructed in accordance with the principles of the present invention.
Figure 15:
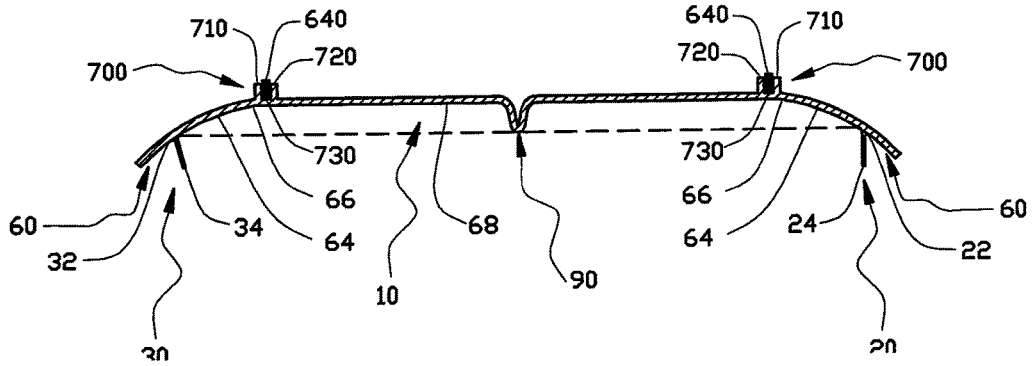
FIG. 15 is a sectional view taken along lines 15-15 of FIG. 14.

Referring now to FIGS. 14-15, an alternative assisted eating aid, generally designated 10, depicts a variation of the underside of the bottom 68 having a movement resistant system 700 comprised of two or more integrally formed protruding concentric rings 710 and 720, each having a different radius and closed ends 740 providing a recessed vacant parcel 730 (FIGS. 12 and 18) within the bounds the concentric rings 710 and 720 and the ends 740 providing for the insertion of a movement resistant material 640. The movement resistant material may be attached either temporarily or permanently by various means and being of various cross sectional shapes including but not just limited to square, or rounded and having a height greater than the protruding concentric rings 710 and 720 as a means of providing a variation of the movement resistant system between the eating vessel 10 and the surface upon where it sits.

Figure 16:
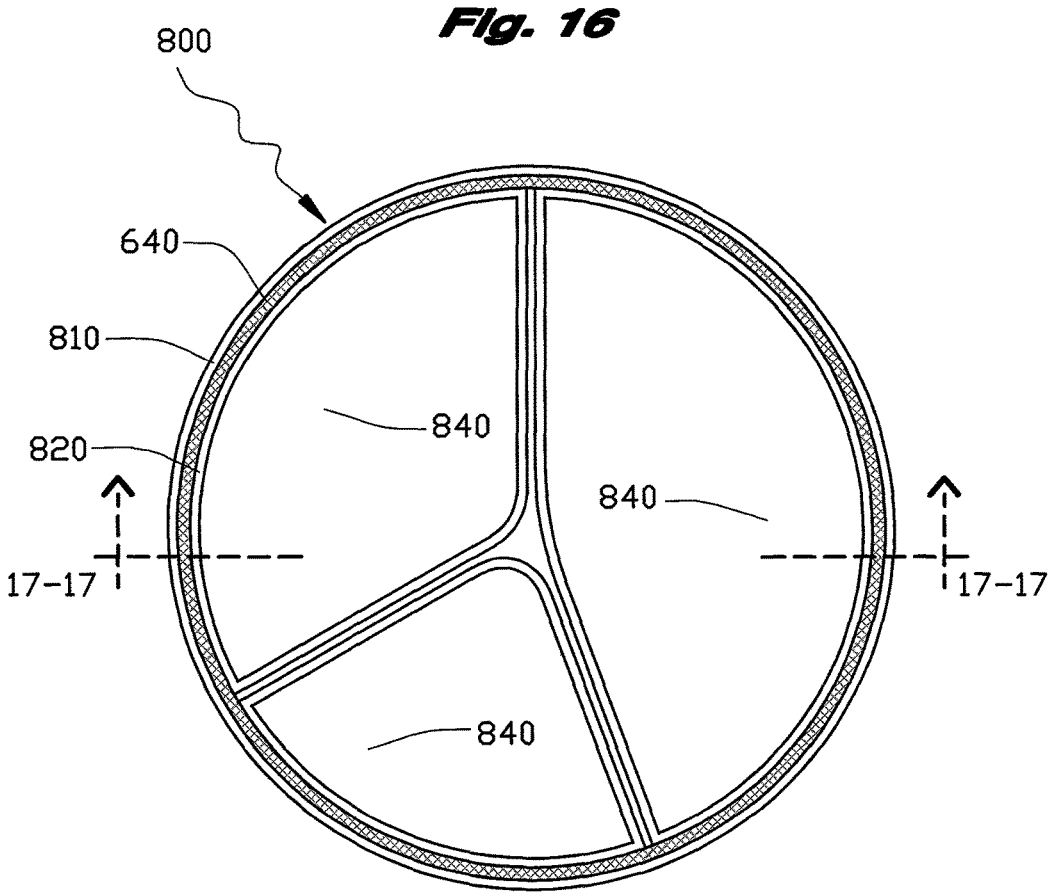
FIG. 16 is a bottom view of another alternative embodiment constructed in accordance with the principles of the present invention illustrating a detachable base component.

Referring to FIGS. 16-17, yet another exemplary embodiment of an assisted eating aid, generally designed 10 is shown as a detachable movement resistant system 800 having an integrally formed disk 840 with a set of integrally formed internal upward partition components 860 of various heights and various shapes consisting of but not just limited to protruding upward and inward sides 864 commencing at the intersection 842 with the disk 840 and matching the underside of the internal partition components 860 shape and size as described in but not just limited to FIG. 1, also illustrating two or more downward protruding integrally formed concentric rings 810 and 820 each having a different radius producing a recessed vacant parcel 850 within the bounds the concentric rings 810 and 820 for the insertion of a movement resistant material 830. The movement resistant material may be attached either temporarily or permanently by various means and being of various cross sectional shapes including but not just limited to square, or rounded and having a height greater than the protruding concentric rings 810 and 820 as a means of providing a variation of the movement resistant system laying between the eating vessel 10 and the surface upon where it sits.

Turning now to FIG. 18, yet another exemplary embodiment of an assisted eating aid, generally designed 10 is shown an attached movement resistant system 800 (FIG. 17) made from movement resistant material such as but not limited to Santoprene and attached or molded directly to the underside of the bottom 68 attached by various means illustrating a movement resistant barrier between the eating vessel 10 and the surface where it sits.

Figure 19:
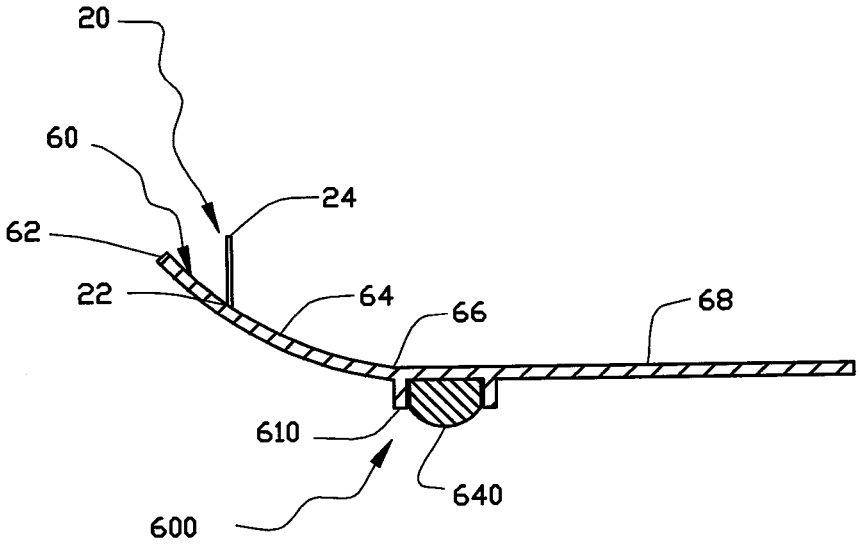
FIG. 19 is a partial sectional view depicting an exemplary variation of to that shown in FIG. 1 and in accordance with the principles of the present invention.

Turning now to FIGS. 19-24, several close-ups of the outer perimeter of a number of alternative assisted eating aids are shown with variations of the flange components, outer shelf, and movement resistant systems. In FIG. 19, the integral flange components 20 protrude vertically upwardly to a summit 24. Further illustrated is the secondary catch ledge 60 (See FIG. 3) the outer measurement perimeter 62 and the movement resistant system 600 (See FIGS. 3 and 5).

Figure 20:
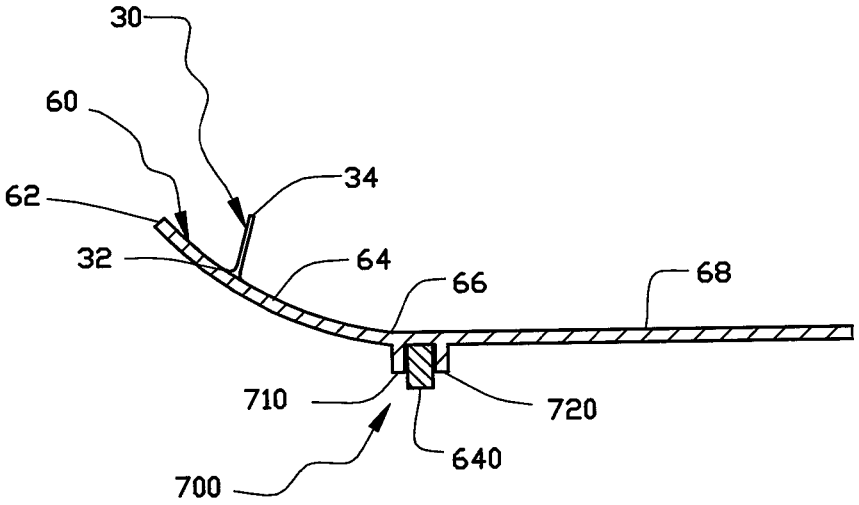
FIG. 20 is a partial sectional view depicting another exemplary variation to that shown in FIG. 1 and in accordance with the principles of the present invention.

In FIG. 20, the integral flange components 30 protrude upwardly and inwardly to a summit 34 being of various heights and various angles described in but not just limited to FIG. 3. Further illustrated is the secondary catch ledge 60 (See FIG. 3) the outer measurement perimeter 62 and the movement resistant system 700.

Figure 21:
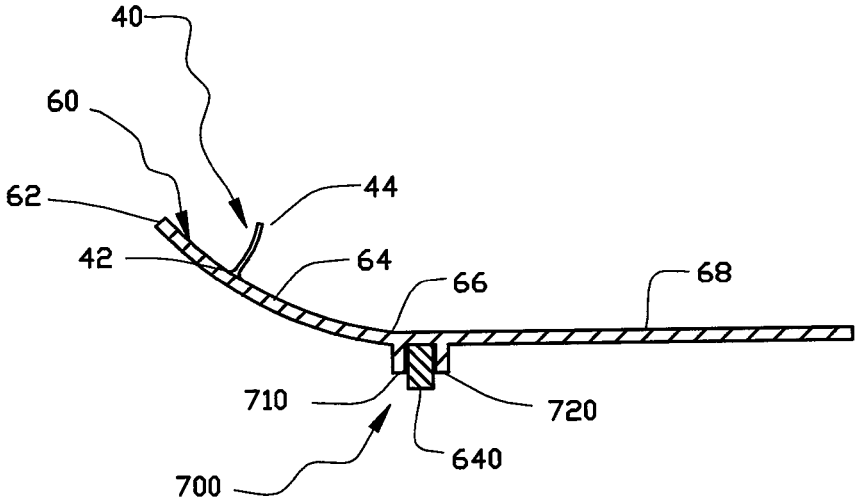
FIG. 21 is a partial sectional view depicting another exemplary variation to that shown in FIG. 1 and in accordance with the principles of the present invention.

In FIG. 21, the integral flange components 40 protrude upwardly and inwardly to a summit 44 being of various heights and a greater angle described in but not just limited to FIG. 3. Further illustrated is the secondary catch ledge 60 (See FIG. 3) the outer measurement perimeter 62 and the movement resistant system 700. In this exemplary embodiment, the secondary catch ledge curves upwardly from the base of the flange to incorporate gravity to force food back toward the exterior surface of the flange. The arcuate flanges are generally concave facing outwards to provide an exterior scooping surface that prevents food from spilling back into the central food receiving area due to the tilt of the secondary catch ledge. It will be appreciated that the arcuate exterior surface of the flanges facilitates scooping food back onto the eating utensil from the secondary catch ledge.

Figure 22:
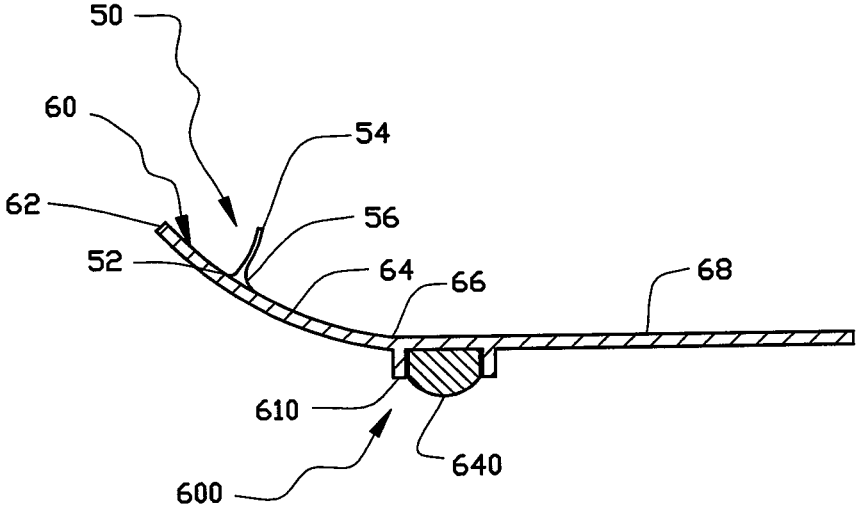
FIG. 22 is a partial sectional view depicting another exemplary variation to that shown in FIG. 1 and in accordance with the principles of the present invention.

In FIG. 22 the integral flange components 50 protrude upwardly to a summit 54 incorporating an internally positioned arcuate upward base 56 transitioning to an angular plane of the flange component 50 being of various heights 54, and various angles described in but not just limited to FIG. 3. Further illustrated are the secondary catch ledge 60, and the movement resistant system 600. (See FIG. 3). Similar to the flange components 40 in FIG. 21, the flange components 50 in FIG. 22 also incorporate an arcuate exterior scooping surface.

Figure 23:
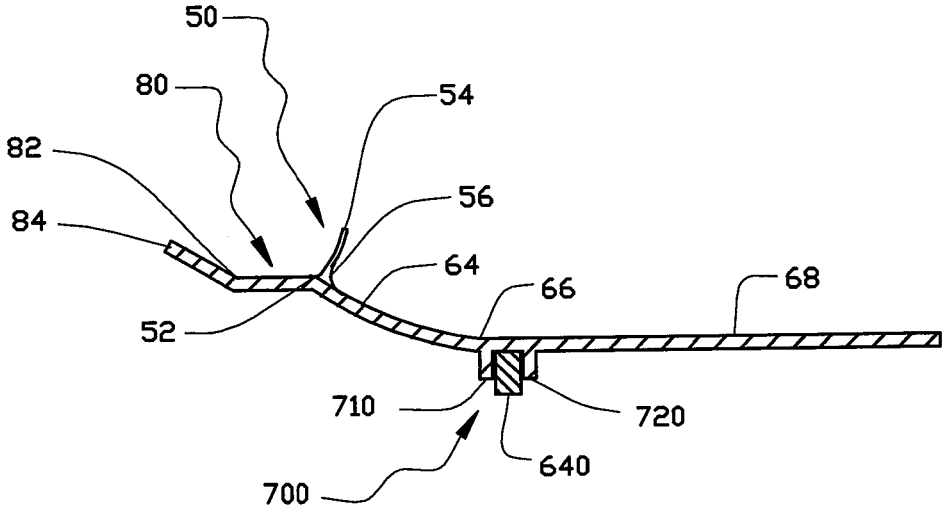
FIG. 23 is a partial sectional view depicting another exemplary variation to that shown in FIG. 1 and in accordance with the principles of the present invention.

As shown in FIG. 23, the integral flange components 50 are similar in construction to those illustrated in FIG. 22. However, a variation of the secondary back up catch system 80 is illustrated in the form of but not just limited to a ledge commencing at the intersection of the flange component 52 and the arcuate side 64 extending horizontally outwardly to a perimeter measurement greater than the flange base 52 and less than the outer perimeter measurement 62 thus creating an additional intersection 82 where the catch ledge 80 now forms an upward plane of various angles, in this case an angular upward outward plane terminating at the outer perimeter 84. Further illustrated is the movement resistant system 700 (See FIG. 14 and FIG. 15).

Figure 24:
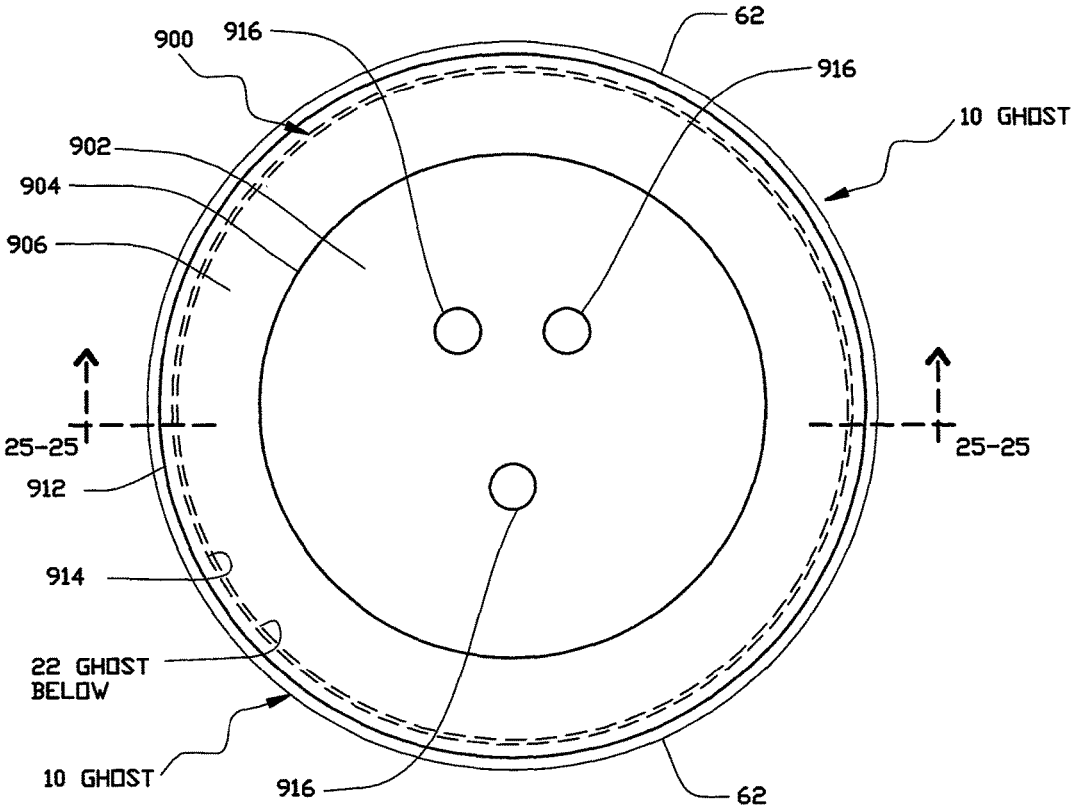
FIG. 24 is a top view of an exemplary lid covering or coverlid that may be used with the round assisted eating aids disclosed herein.
Figure 25:
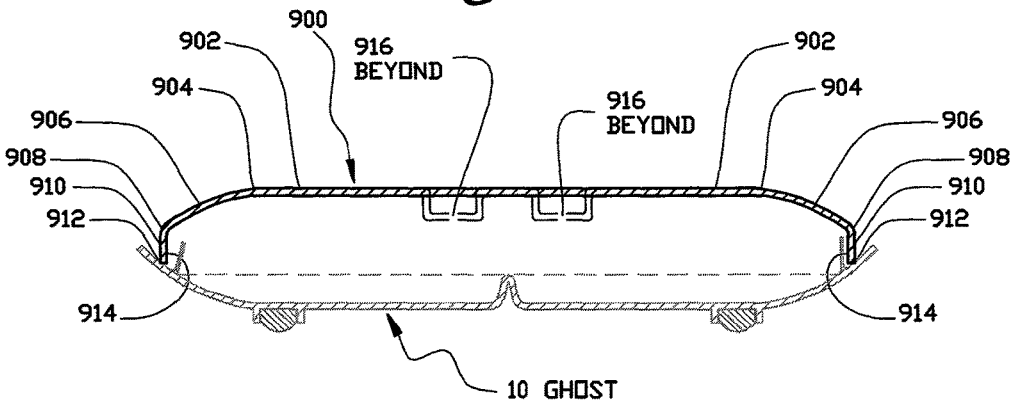
FIG. 25 is a sectional view taken along lines 25-25 of FIG. 24.

Turning now to FIGS. 24-25 a removable coverlid component, generally designated 900, includes an integrally formed assembly of components being of various heights and various shapes corresponding to the shape of the underlying eating vessel 10 illustrated in this case as a saucer with outer perimeter measurement 912 being smaller than the outer perimeter measurement 62 of the underlying vessel 10 and having an internal outer perimeter measurement 914 greater than the outer perimeter measurement of the flange component 20, 30 or 40 thus producing side walls 910 resting on the secondary catch ledge 60 between the flange component 22, 32 and 42 base measurements and the outer perimeter measurement 62 thus extending upward at various angles, illustrated in this case vertically intersecting 908 with the arcuate upward component 906 forming an intersection 904 with the top surface component 902 in this case being a flat surface having a perimeter measurement of sufficient size to allow for the integration of lid handle components of various sizes, shapes, heights or depths, in this case comprised of numerous circular depressions of similar size and depth configured to allow the placement of terminal members of the hand used in combination with the thumb being inserted into the circular depressions 916 providing a gripping component necessary for the removal of the coverlid from the resting base vessel.

The coverlid 900 may be placed over the underlying vessel 10 as shown in FIG. 25 with the outermost downwardly extending flanges 912 spaced exterior to the upwardly projecting flange components 914 of the vessel 10 and resting atop the exterior catch all shelf or ledge near the outermost extent 62 of the vessel.

Figure 26:
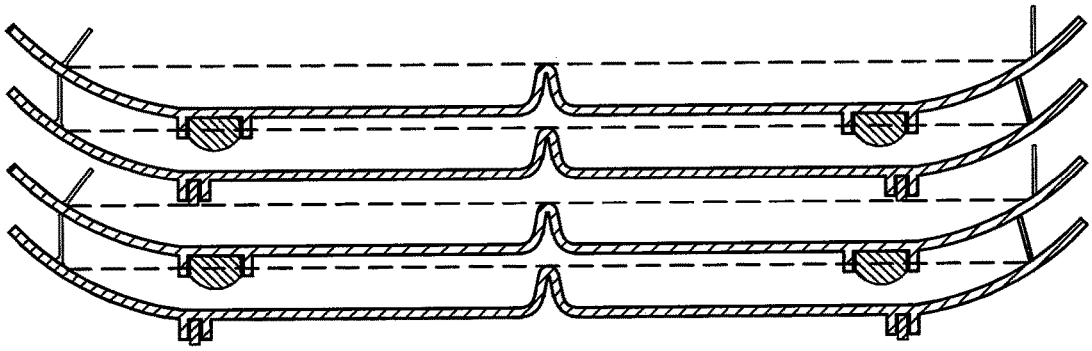
FIG. 26 is a side view showing an exemplary stacking arrangement of multiple assisted eating aids constructed in accordance with the principles of the present invention.

FIG. 26 is a side view showing an exemplary stacking arrangement of multiple assisted eating aids constructed in accordance with the principles of the present invention.

It will be appreciated that the size of the assisted eating aid may be larger than conventional serving dishes with high sidewalls allowing for a greater amount of food to be placed thereon. For example, many of the conventional circular serving vessels are limited to a seven and a quarter inch diameter, much less than a typical flat dinner plate. However, as an example, the assisted eating aid described herein may easily be constructed the same size as a conventional dinner plate, around nine inches in diameter to the interior perimeter of the catch all ledge. This example is not meant to be limiting and other suitable assisted eating dimensions will occur to those of ordinary skill in the art.

It will further be appreciated that features on each of the embodiments described (such as, but not limited to, flange location, height, and spacing) may be interchangeable or useful with other embodiments as would occur to one of ordinary skill in the art. Overall, the problem of providing a serving vessel or assisted eating aid that accomplishes one or more of the objectives described herein may be provided by a serving vessel having one or more food receiving sections at least partially surrounded by a set of one or more upwardly projecting flanges or fins which are in turn at least partially surrounded by a catch all ledge to inhibit food spilled over a flange from falling completely off the serving vessel. Food that reaches the catch-all ledge may be recaptured with a utensil by scooping the food along the outermost surface of the flange. The flanges may be of various heights and angles to accommodate different food groups and may be continuous around the entire food section or spaced apart to provide gaps to accommodate washing and disposal of food particles left on the assisted eating aid after use. Such flanges may also be transparent so as not to obscure the food location or utensil location on the assisted eating aid. Internal partitions may be introduced to further assist in segregating food groups while the bottom surface of the assisted eating aid may be fitted with movement resistance materials to inhibit undesired rotation of the assisted eating aid during use.

The spirit of the present invention provides a breadth of scope that includes all methods of making and using it. Any variation on the theme and methodology of accomplishing the same that are not described herein would be considered under the scope of the present invention.

What is claimed is:

1. An assisted eating aid comprising:

a central bottom region with a flat surface surrounded by a circumferential dividing line;

an arcuate side defining an annular region adjacent to and circumscribing the entire central bottom region, the annular region extending upwardly and outwardly from the circumferential dividing line to terminate at an outermost circular perimeter positioned above the flat surface of the central bottom region;

a plurality of flanges with each flange including a base abutting the annular region at a location recessed from the outermost circular perimeter and an uppermost summit with the respective bases and summits of at least two adjacent flanges being spaced apart concentrically about the central bottom region within the annular region to define a gap between the at least two adjacent flanges, at least one flange further including an interior facing food loading surface projecting upwardly from the base and inwardly toward the central bottom region to dispose an uppermost summit of the at least one flange closer to the central bottom region than the base of the at least one flange, the at least one flange further including an upwardly projecting exterior facing food loading surface recessed from the outer circular perimeter; and a catchall ledge within the annular region disposed between an exterior facing food loading surface of the at least one flange of the plurality of flanges and the outermost circular perimeter to catch a portion of food falling over the summit of an adjacent flange.

2. The assisted eating aid of claim 1 further including:

a movement resistant material located on at least a portion of the central bottom region.

3. The assisted eating aid of claim 1 wherein:

the summit of the at least one flange is a single height relative to the upper flat surface of the central bottom region.

4. The assisted eating aid of claim 1 wherein:

the base of the at least one flange is fixed to the arcuate side and the summit of the least one flange is free.

5. The assisted eating aid of claim 1 wherein:

at least one flange of the plurality of flanges projects at a right angle from the arcuate side relative to the upper flat surface of the central bottom region.

6. The assisted eating aid of claim 1 wherein:

at least one inwardly projecting flange of the plurality of flanges includes a first radius of curvature that matches a radius of curvature of the outermost perimeter of the annular region when viewed from above.

7. The assisted eating aid of claim 1 wherein:

the base of the at least one flange meets the arcuate side at a location above the upper flat surface of the central bottom region.

8. The assisted eating aid of claim 1 wherein:

a summit of at least one flange is higher relative to a summit of at least one other flange relative to the upper flat surface of the central bottom region.

9. An assisted eating aid comprising:

a central bottom region with an upper flat surface surrounded by a circumferential dividing line;

an arcuate sidewall defining an annular region adjacent to and circumscribing the entire central bottom region, the annular region extending upwardly and outwardly from the circumferential dividing line to terminate at an outermost circular perimeter positioned above the upper flat surface of the central bottom region;

a first flange set including at least one flange having a base abutting the arcuate sidewall of the annular region at a location recessed from the outermost circular perimeter, the at least one flange further including an interior facing food loading surface projecting upwardly from the base and inwardly toward the central bottom region to dispose an uppermost free edge of the at least one flange closer to the central bottom region than the base of the at least one flange, the at least one flange being constructed to present an obstacle to outward movement starting from along the upper flat surface toward the at least one flange and along the upper surface of the annular region;

a second flange set spaced apart from the first flange set in the same concentric location within the annular region, the second flange set including one or more flanges projecting vertically upwards from the annular region relative to the upper flat surface of the central bottom region; and a catchall ledge within the annular region disposed between an exterior facing scoop surface of the at least one flange and the outermost circular perimeter to catch a portion of food falling over the uppermost free edge of the at least one flange.

10. An assisted eating aid comprising:

a central bottom region with an upper flat surface surrounded by an inner circular perimeter;

a sidewall defining an annular region adjacent to and circumscribing the entire central bottom region, the annular region extending upwardly and outwardly from the interior circular perimeter to terminate at an outermost circular perimeter positioned above the upper flat surface of the central bottom region;

a first set of concentrically spaced apart flanges defining a first gap of a first width between adjacent flanges with at least one flange including a base abutting the annular region at a location recessed from the outermost circular perimeter, the at least one flange further including an interior facing food loading surface projecting upwardly from the base and inwardly toward the central bottom region to dispose an uppermost free edge of the at least one flange closer to the central bottom region than the base of the at least one flange;

a second set of flanges with the second set of flanges being concentrically spaced apart from the first set of flanges to form a second gap larger than the first gap; and a catchall ledge within the annular region disposed between an exterior facing food loading surface of the at least one flange and the outermost circular perimeter to catch a portion of food falling over the uppermost free edge of the at least one flange.

11. The assisted eating aid of claim 10 wherein:

the first set of flanges is disposed on one half of the annular region and the second set of flanges is disposed on an opposing half of the annular region.

* * * * *